US007366661B2

(12) United States Patent
Tsuji et al.

(10) Patent No.: US 7,366,661 B2
(45) Date of Patent: Apr. 29, 2008

(54) INFORMATION EXTRACTING DEVICE

(75) Inventors: Minoru Tsuji, Chiba (JP); Shiro Suzuki, Kanagawa (JP); Keisuke Toyama, Tokyo (JP)

(73) Assignee: Sony Corporation, Tokyo (JP)

( * ) Notice: Subject to any disclaimer, the term of this patent is extended or adjusted under 35 U.S.C. 154(b) by 712 days.

(21) Appl. No.: 10/203,733

(22) PCT Filed: Dec. 14, 2001

(86) PCT No.: PCT/JP01/10976

§ 371 (c)(1),
(2), (4) Date: Nov. 4, 2002

(87) PCT Pub. No.: WO02/49001

PCT Pub. Date: Jun. 20, 2002

(65) Prior Publication Data

US 2003/0139830 A1 Jul. 24, 2003

(51) Int. Cl.
*G10L 11/00* (2006.01)
*G10L 13/00* (2006.01)
*G10L 19/00* (2006.01)

(52) U.S. Cl. ..... 704/220; 704/258; 704/219

(58) Field of Classification Search ..... 704/219, 704/220, 258

See application file for complete search history.

(56) References Cited

U.S. PATENT DOCUMENTS 5,228,086 A 7/1993 Morii et al.
5,731,767 A * 3/1998 Tsutsui et al. ..... 704/225

(Continued)

FOREIGN PATENT DOCUMENTS

EP 0337636 10/1989

(Continued)

OTHER PUBLICATIONS

Communication for European Patent Application No. 01 270 874. 9-2225.

(Continued)

*Primary Examiner*—Tälivaldis Ivars Šmits
(74) *Attorney, Agent, or Firm*—Sonnenschein Nath & Rosenthal LLP

(57) ABSTRACT

The present invention relates to an information extraction apparatus capable of analyzing an acoustic signal with accuracy and high efficiency.

An amplitude analysis section 32 determines whether or not an attack or release is contained on the basis of an amplitude value for each small region of an input time-series signal. When it is determined that there is an attack or release, an analysis region setting section 33 sets the portion from an attack position to a release position as an analysis region. A frequency analysis section 34 analyzes the input time-series signal by generalized harmonic analysis and outputs extracted waveform information. An extracted waveform synthesis section 35 synthesizes the extracted waveform information and outputs the information to a time-series compensation section 36. The time-series compensation section 36 compensates the signal of the synthesized result with a signal outside the analysis region and outputs an extracted waveform time-series signal to a subtraction unit 37. The subtraction unit 37 generates a residual time-series signal from the input time-series signal and the extracted waveform time-series signal. The present invention can be applied to various audio apparatuses, voice recognition apparatuses, voice synthesis apparatuses, etc., for processing an acoustic signal.

16 Claims, 14 Drawing Sheets

U.S. PATENT DOCUMENTS

| | | | | |
|---|---|---|---|---|
| 5,832,437 | A | 11/1998 | Nishiguchi et al. | |
| 6,044,341 | A * | 3/2000 | Takahashi | 704/226 |
| 6,233,550 | B1 * | 5/2001 | Gersho et al. | 704/208 |
| 6,239,345 | B1 * | 5/2001 | Laroche | 84/604 |
| 6,475,245 | B2 * | 11/2002 | Gersho et al. | 704/208 |

FOREIGN PATENT DOCUMENTS

| | | |
|---|---|---|
| EP | 457161 | 11/1992 |
| EP | 698876 | 2/1996 |
| EP | 0837453 | 4/1998 |
| JP | 60-91227 | 5/1985 |
| JP | 60-97397 | 5/1985 |
| JP | 4-125700 | 4/1992 |
| JP | 1993-046198 | 2/1993 |
| JP | 5-66774 | 3/1993 |
| JP | 5-73098 | 3/1993 |
| JP | 07-261798 | 10/1995 |
| JP | 1995-325583 | 12/1995 |
| JP | 8-63197 | 3/1996 |
| JP | 1996-221098 | 8/1996 |
| JP | 1998-020888 | 1/1998 |
| JP | 10-207445 | 8/1998 |
| JP | 2000-134105 | 5/2000 |
| JP | 2000-261322 | 9/2000 |
| JP | 2000-276173 | 10/2000 |

OTHER PUBLICATIONS

Bernd Edler, et al., ASAC—Analysis/Synthesis Audio Codec for Very Low Bit Rates, University of Hannover, Germany.

* cited by examiner

INFORMATION EXTRACTING DEVICE

TECHNICAL FIELD

The present invention relates to an information extraction apparatus and, more particularly, to an information extraction apparatus capable of extracting or synthesizing frequency components with accuracy and high efficiency.

BACKGROUND OF THE INVENTION

Hitherto, as a method of analyzing a frequency of an acoustic signal, etc., generalized harmonic analysis has been used. In this method, the most dominant sine wave is extracted from the original time-series signal within an analysis region and, by using the residual components thereof as an input, the same process is repeated. Generalized harmonic analysis is described in "The Fourier integral and certain of its applications" by N. Weiner, Dover Publications, Inc., (1958).

According to this generalized harmonic analysis, since an influence of an analysis window (analysis region) is not imposed, accurate extraction of frequency components is possible with respect to a slight frequency variation of an input signal. Furthermore, the analysis region and the resolution of the frequency can be set independently of each other, and it is possible to predict a signal beyond the analysis region.

Therefore, as an apparatus for performing frequency analysis on a time-series signal such as an acoustic signal and for extracting specific frequency components, a frequency-component extraction apparatus using generalized harmonic analysis has been conceived.

FIG. 1 is a block diagram showing an example of the configuration of a conventional frequency-component extraction apparatus.

An input signal dividing section 11 divides, for example, an acoustic time-series signal into predetermined analysis regions when that signal is input as an input signal, and supplies the obtained input time-series signal to a frequency analysis section 12 and a subtraction unit 14.

The frequency analysis section 12 analyzes the input time-series signal by using generalized harmonic analysis, creates extracted waveform information, such as the amplitude and the phase, on main frequency components in an analysis region, and supplies the information to an extracted waveform synthesis section 13 and to, for example, a data compression section (not shown) provided outside a frequency-component extraction apparatus 1.

The extracted waveform synthesis section 13 performs predetermined waveform synthesis on the basis of a plurality of pieces of extracted waveform information supplied from the frequency analysis section 12, and outputs the obtained extracted waveform time-series signal to the subtraction unit 14.

The subtraction unit 14 performs subtraction in a time domain on the basis of the extracted waveform time-series signal supplied from the extracted waveform synthesis section 13 and the input time-series signal supplied from the input signal dividing section 11, and outputs the obtained residual time-series signal to an apparatus at a subsequent stage, provided outside the frequency-component extraction apparatus 1.

Next, the operation of the frequency-component extraction apparatus 1 of FIG. 1 is described with reference to the flowchart in FIG. 2. Each signal which is generated is described as appropriate using FIG. 3A. In FIG. 3A, an example of a signal in a case where there is no attack (sharp rise) or release (sharp fall) in an input time-series signal is shown.

In step S1, the input signal dividing section 11 divides an input acoustic time-series signal into predetermined analysis regions, and outputs the generated input time-series signal into the frequency analysis section 12 and the subtraction unit 14. For example, as shown in FIG. 3A, the input signal dividing section 11 divides an acoustic time-series signal at an analysis region L and outputs the resulting input time-series signal s1 to the frequency analysis section 12 and the subtraction unit 14.

In step S2, the frequency analysis section 12 receiving the input time-series signal computes frequency components at which the energy of a residual signal reaches a minimum when the frequency components are extracted from the input time-series signal. That is, in step S2, the frequency analysis section 12 computes the energy of the residual signal with respect to all the frequencies (frequency for each small region of a predetermined number of samples) of the analysis region in order to obtain the frequency at which the energy of the residual signal reaches a minimum.

In step S3, the frequency analysis section 12 subtracts a pure-tone signal corresponding to the frequency computed in step S2 from the input time-series signal in order to generate a residual signal. Then, in step S4, the frequency analysis section 12 creates extracted waveform information corresponding to the frequency computed in step S2 and supplies the information to the extracted waveform synthesis section 13. The extracted waveform information contains information, such as the frequency, the amplitude, and the phase, of the signal corresponding to the extracted frequency components. Furthermore, the frequency analysis section 12 outputs the extracted waveform information to an apparatus (not shown) provided outside the frequency-component extraction apparatus 1.

In step S5, the frequency analysis section 12 computes the energy (residual energy) of the residual signal generated in step S3, and determines whether or not the residual energy is less than a predetermined threshold value. When it is determined that the residual energy is greater than the predetermined threshold value, the process proceeds to step S6.

In step S6, the frequency analysis section 12 assumes the residual signal to be an input signal, and the process returns to step S2, where this and subsequent processes are repeatedly performed. That is, a plurality of pieces of extracted waveform information corresponding to the number of times in which the processes of steps S2 to S6 are repeated is supplied to the extracted waveform synthesis section 13.

When the frequency analysis section 12 determines in step S5 that the residual energy is less than the predetermined threshold value, the process proceeds to step S7.

In step S7, the extracted waveform synthesis section 13 performs predetermined waveform synthesis on the basis of the plurality of pieces of extracted waveform information supplied from the frequency analysis section 12 in order to generate an extracted waveform time-series signal. The extracted waveform synthesis section 13 generates, for example, an extracted waveform time-series signal s2 such as that shown in FIG. 3A. When the input time-series signal s1 does not contain an attack or release, the input time-series signal s1 and the extracted waveform time-series signal s2 become substantially the same waveform.

The extracted waveform time-series signal generated in step S7 is output to the subtraction unit 14. In step S8, a residual time-series signal is generated from the difference from the input time-series signal supplied from the input signal dividing section 11. That is, a residual time-series signal s3 becomes substantially a standing waveform, as shown in FIG. 3A, and in step S9, the signal is output to an apparatus (not shown) at a subsequent stage.

The extracted waveform information which is analyzed and output to a subsequent stage by the frequency analysis section 12 is coded and then stored or transmitted. Therefore, from the viewpoint of the amount of data, a lesser number of frequency components is preferable.

However, when the input time-series signal within the analysis region contains an attack or release, it is difficult to represent the attack or the release with a limited number of frequency components.

For example, as shown in FIG. 3B, when an input time-series signal s11 contains an attack or release, information capable of accurately representing the wave of the attack or the release cannot be supplied to the extracted waveform synthesis section 13. Consequently, in the residual time-series signal s13, components which do not originally exist appear before or after the portion where the attack or release has occurred, and the frequency components cannot be efficiently extracted.

SUMMARY OF THE INVENTION

The present invention has been made in view of such circumstances. The present invention is achieved to be capable of extracting or synthesizing frequency components with accuracy and high efficiency.

An information extraction apparatus in accordance with a first aspect of the present invention comprises: input signal dividing means for dividing an input signal into predetermined regions; amplitude-value computation means for computing an amplitude value of the input signal divided by the input signal dividing means; analysis region setting means for setting an analysis region on the basis of the amplitude value computed by the amplitude-value computation means; waveform information extraction means for extracting waveform information of the input signal of the analysis region set by the analysis region setting means; synthesized waveform generation means for generating a synthesized waveform on the basis of the waveform information extracted by the waveform information extraction means; and residual signal generation means for generating a residual signal on the basis of the input signal divided by the input signal dividing means and the synthesized waveform generated by the synthesized waveform generation means.

The information extraction apparatus may further comprise compensation means for compensating the synthesized waveform generated by the synthesized waveform generation means with a signal corresponding to a region outside the analysis region set by the analysis region setting means.

The compensation means may compensate the signal corresponding to a region outside the analysis region with a signal at a fixed level.

The amplitude-value computation means may detect an attack position of the input signal, and the analysis region setting means may set the attack position of the input signal, detected by the amplitude-value computation means, as the start position of the analysis region.

The amplitude-value computation means may detect a release position of the input signal, and the analysis region setting means may set a release position of the input signal, detected by the amplitude-value computation means, as the end position of the analysis region.

The waveform information extraction means may extract the waveform information by using generalized harmonic analysis from the input signal of the analysis region set by the analysis region setting means.

The synthesized waveform generation means may multiply a part of the synthesized waveform with a predetermined function.

An information extraction method for use with the information extraction apparatus in accordance with a first aspect of the present invention comprises: an input signal dividing step of dividing an input signal into predetermined regions; an amplitude-value computation step of computing an amplitude value of the input signal divided by a process of the input signal dividing step; an analysis region setting step of setting an analysis region on the basis of the amplitude value computed by a process of the amplitude-value computation step; a waveform information extraction step of extracting waveform information of the input signal of the analysis region set by a process of the analysis region setting step; a synthesized waveform generation step of generating a synthesized waveform on the basis of the waveform information extracted by a process of the waveform information extraction step; and a residual signal generation step of generating a residual signal on the basis of the input signal divided by a process of the input signal dividing step and the synthesized waveform generated by a process of the synthesized waveform generation step.

A program recorded on a recording medium in accordance with a first aspect of the present invention comprises: an input signal dividing step of dividing an input signal into predetermined regions; an amplitude-value computation step of computing an amplitude value of the input signal divided by a process of the input signal dividing step; an analysis region setting step of setting an analysis region on the basis of the amplitude value computed by a process of the amplitude-value computation step; a waveform information extraction step of extracting waveform information of the input signal of the analysis region set by a process of the analysis region setting step; a synthesized waveform generation step of generating a synthesized waveform on the basis of the waveform information extracted by a process of the waveform information extraction step; and a residual signal generation step of generating a residual signal on the basis of the input signal divided by a process of the input signal dividing step and the synthesized waveform generated by a process of the synthesized waveform generation step.

An information extraction apparatus in accordance with a second aspect of the present invention comprises: input signal dividing means for dividing an input signal into predetermined regions; amplitude-value computation means for computing an amplitude value of the input signal divided by the input signal dividing means; analysis region setting means for setting an analysis region on the basis of the amplitude value computed by the amplitude-value computation means; waveform information extraction means for extracting waveform information of a predetermined frequency of the input signal of the analysis region set by the analysis region setting means; synthesized waveform generation means for generating a synthesized waveform on the basis of the waveform information extracted by the waveform information extraction means; residual signal generation means for generating a residual signal on the basis of the input signal divided by the input signal dividing means and the synthesized waveform generated by the synthesized waveform generation means; comparison means for comparing an energy of the residual signal generated by the residual signal generation means with a predetermined threshold value; and feedback means for feeding back the residual signal, instead of the input signal, to the amplitude-value computation means on the basis of a comparison result by the comparison means.

The information extraction apparatus may further comprise compensation means for compensating the synthesized waveform generated by the synthesized waveform generation means with a signal corresponding to a region outside the analysis region set by the analysis region setting means, wherein the residual signal generation means may generate a residual signal on the basis of the input signal divided by the input signal dividing means and a signal compensated for by the compensation means.

The compensation means may compensate a signal corresponding to a region outside the analysis region with a signal at a fixed level.

The amplitude-value computation means may detect an attack position of the input signal, and the analysis region setting means may set the attack position of the input signal, detected by the amplitude-value computation means, as the start position of the analysis region.

The amplitude-value computation means may detect a release position of the input signal, and the analysis region setting means may set a release position of the input signal, detected by the amplitude-value computation means, as the end position of the analysis region.

The waveform information extraction means may extract the waveform information by using generalized harmonic analysis from the input signal of the analysis region set by the analysis region setting means.

The synthesized waveform generation means may multiply a part of the synthesized waveform with a predetermined function.

An information extraction method for use with the information extraction apparatus in accordance with a second aspect of the present invention comprises: an input signal dividing step of dividing an input signal into predetermined regions; an amplitude-value computation step of computing an amplitude value of the input signal divided by a process of the input signal dividing step; an analysis region setting step of setting an analysis region on the basis of the amplitude value computed by a process of the amplitude-value computation step; a waveform information extraction step of extracting waveform information of a predetermined frequency of the input signal of the analysis region set by a process of the analysis region setting step; a synthesized waveform generation step of generating a synthesized waveform on the basis of the waveform information extracted by a process of the waveform information extraction step; a residual signal generation step of generating a residual signal on the basis of the input signal divided by a process of the input signal dividing step and the synthesized waveform generated by a process of the synthesized waveform generation step; a comparison step of comparing an energy of the residual signal generated by a process of the residual signal generation step with a predetermined threshold value; and a feedback step of feeding back the residual signal, instead of the input signal, to a process of the amplitude-value computation step on the basis of a comparison result of a process of the comparison step.

A program recorded on a recording medium in accordance with a second aspect of the present invention comprises: an input signal dividing step of dividing an input signal into predetermined regions; an amplitude-value computation step of computing an amplitude value of the input signal divided by a process of the input signal dividing step; an analysis region setting step of setting an analysis region on the basis of the amplitude value computed by a process of the amplitude-value computation step; a waveform information extraction step of extracting waveform information of a predetermined frequency of the input signal of the analysis region set by a process of the analysis region setting step; a synthesized waveform generation step of generating a synthesized waveform on the basis of the waveform information extracted by a process of the waveform information extraction step; a residual signal generation step of generating a residual signal on the basis of the input signal divided by a process of the input signal dividing step and the synthesized waveform generated by a process of the synthesized waveform generation step; a comparison step of comparing an energy of the residual signal generated by a process of the residual signal generation step with a predetermined threshold value; and a feedback step of feeding back the residual signal, instead of the input signal, to by a process of the amplitude-value computation step on the basis of a comparison result by a process of the comparison step.

An information synthesis apparatus of the present invention, for receiving information on an extraction region, waveform information, and a residual signal from an information extraction apparatus for dividing an input signal into predetermined regions, setting an extraction region within the divided region, extracting waveform information of the extracted region, generating synthesized waveform from the extracted waveform information, and generating a residual signal on the basis of a signal in the divided region and the synthesized waveform, comprises: synthesis region setting means for setting a synthesis region on the basis of information on the extracted region; synthesized signal generation means for generating a synthesized signal on the basis of the waveform information; and reproduced signal generation means for generating a reproduced signal on the basis of the residual signal and the synthesized signal.

The information synthesis apparatus may further comprise compensation means for compensating the synthesized signal generated by the reproduced signal generation means with a signal corresponding to a region outside the synthesis region set by the synthesis region setting means.

The compensation means may compensate the signal corresponding to a region outside the synthesis region with a signal at a fixed level.

The synthesis region setting means may set an attack position of the input signal as the start position of the synthesis region on the basis of information on the extracted region.

The synthesis region setting means may set a release position of the input signal as the end position of the synthesis region on the basis of information on the extracted region.

An information synthesis method, for use with an information synthesis apparatus of the present invention, for receiving information on an extracting region, waveform information, and a residual signal received from an information extraction apparatus for dividing an input signal into predetermined regions, setting an extraction region within the divided region, extraction waveform information of the extracted region, generating synthesized waveform from the extracted waveform information, and generating a residual signal on the basis of a signal in the divided region and the synthesized waveform, comprises: a synthesis region setting step of setting a synthesis region on the basis of information on the extracted region; a synthesized signal generation step of generating a synthesized signal from the waveform information; and a reproduced signal generation step of generating a reproduced signal on the basis of the residual signal and the synthesized signal.

A program, recorded on a recording medium in accordance with a third aspect of the present invention, for receiving information on an extraction region, waveform information, and a residual signal from an information extraction apparatus for dividing an input signal into predetermined regions, setting an extraction region within the divided region, extracting waveform information of the extracted region, generating synthesized waveform from the extracted waveform information, and generating a residual signal on the basis of a signal in the divided region and the synthesized waveform, comprises: a synthesis region setting step of setting a synthesis region on the basis of information on the extracted region; a synthesized signal generation step of generating a synthesized signal from the waveform information; and a reproduced signal generation step of generating a reproduced signal on the basis of the residual signal and the synthesized signal.

DETAILED DESCRIPTION OF THE PRESENTLY PREFERRED EMBODIMENTS

Figure 1:
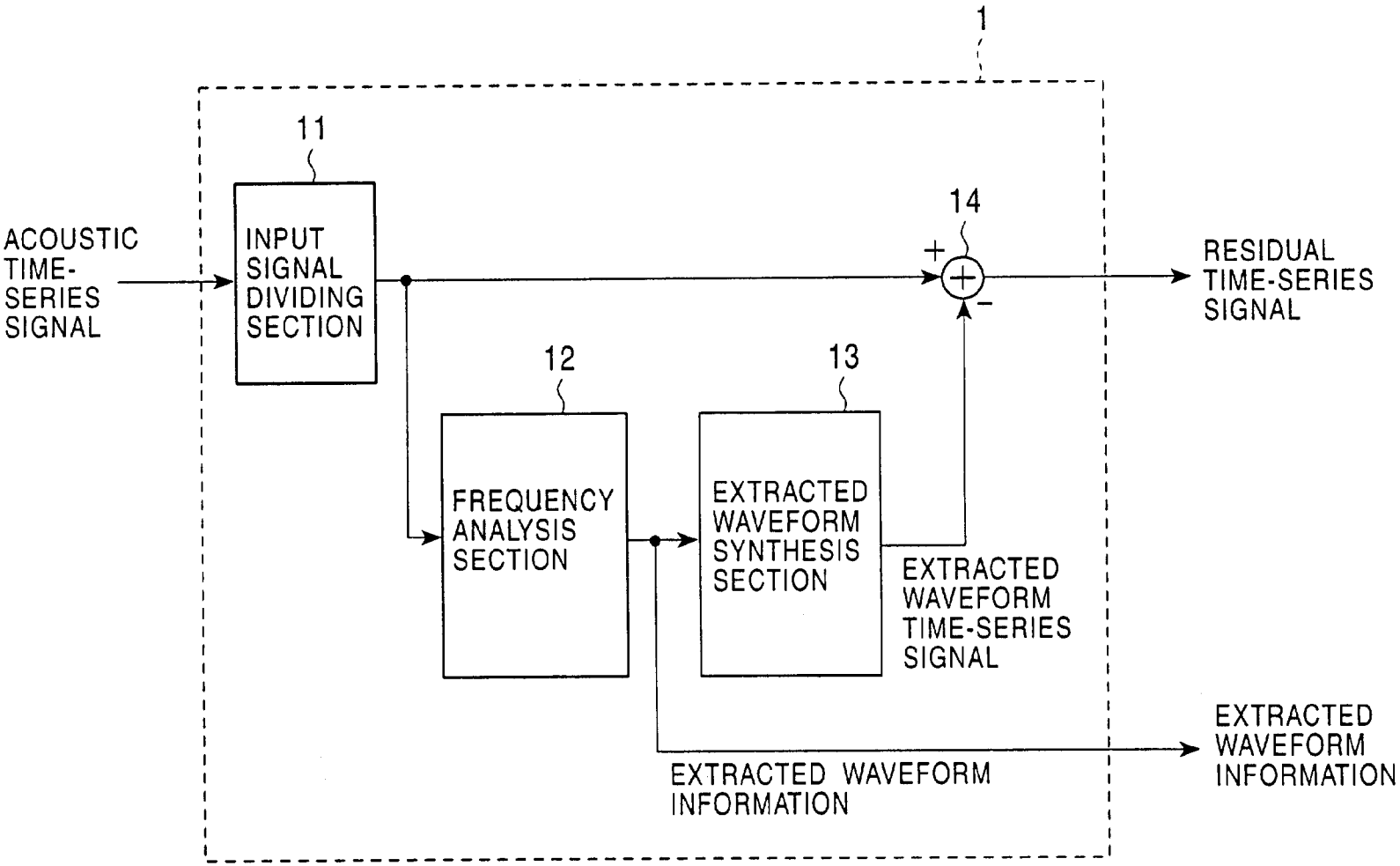
FIG. 1 is a block diagram showing an example of the configuration of a conventional frequency-component extraction apparatus.
Figure 2:
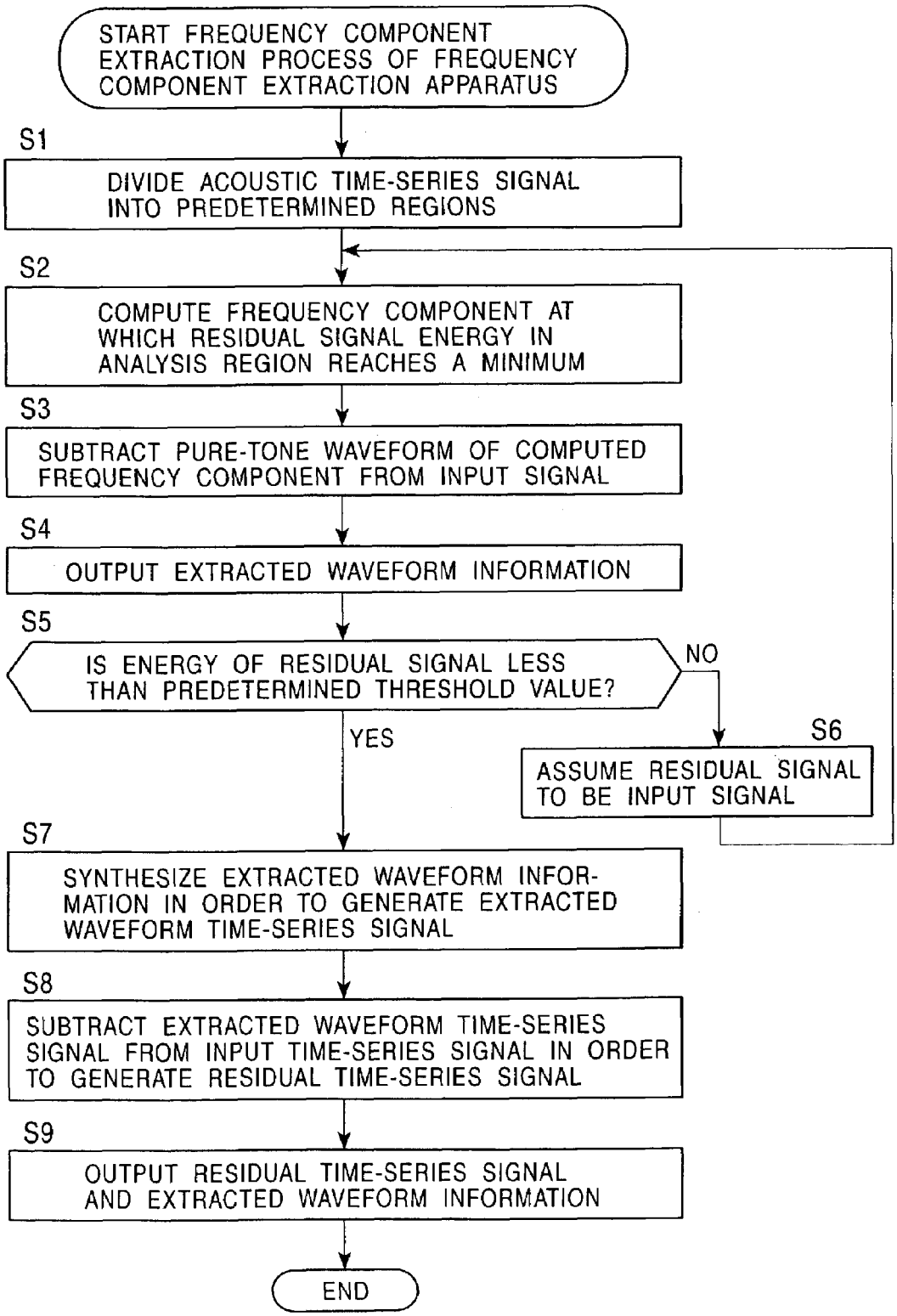
FIG. 2 is a flowchart illustrating processes of the frequency-component extraction apparatus of FIG. 1.
Figure 3A:
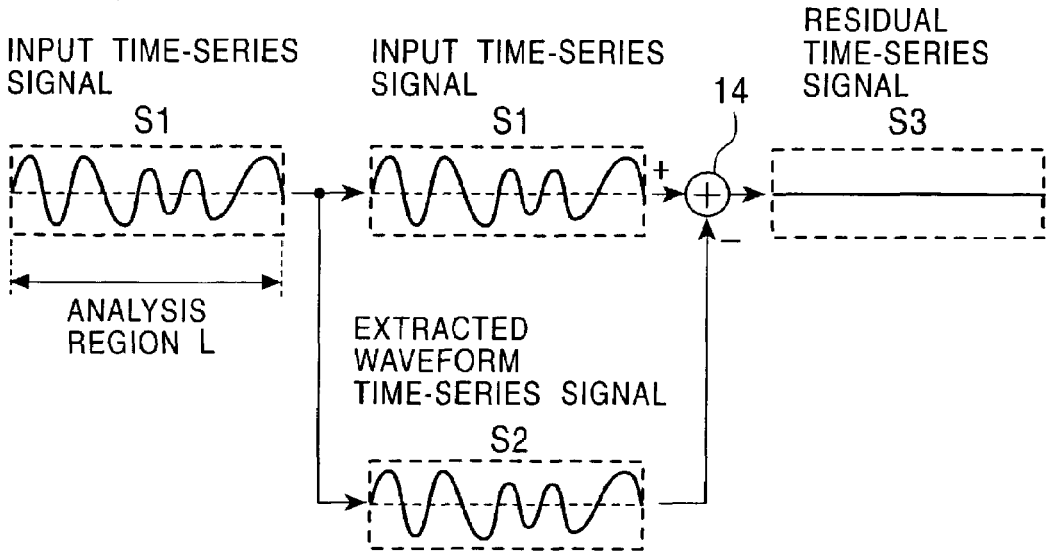
FIG. 3A shows an example of a signal generated by the frequency-component extraction apparatus of FIG. 1.
Figure 3B:
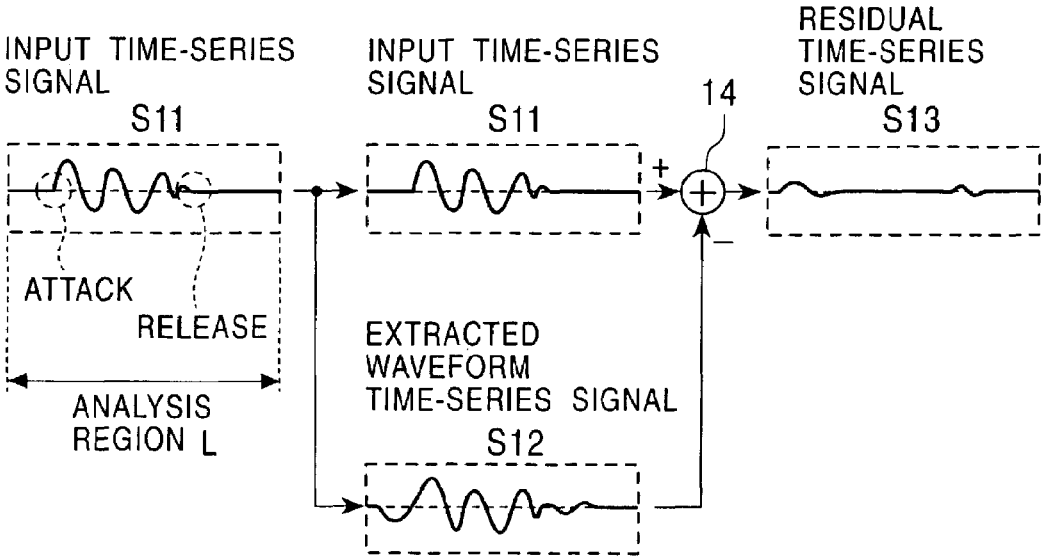
FIG. 3B shows another example of a signal generated by the frequency-component extraction apparatus of FIG. 1.
Figure 4:
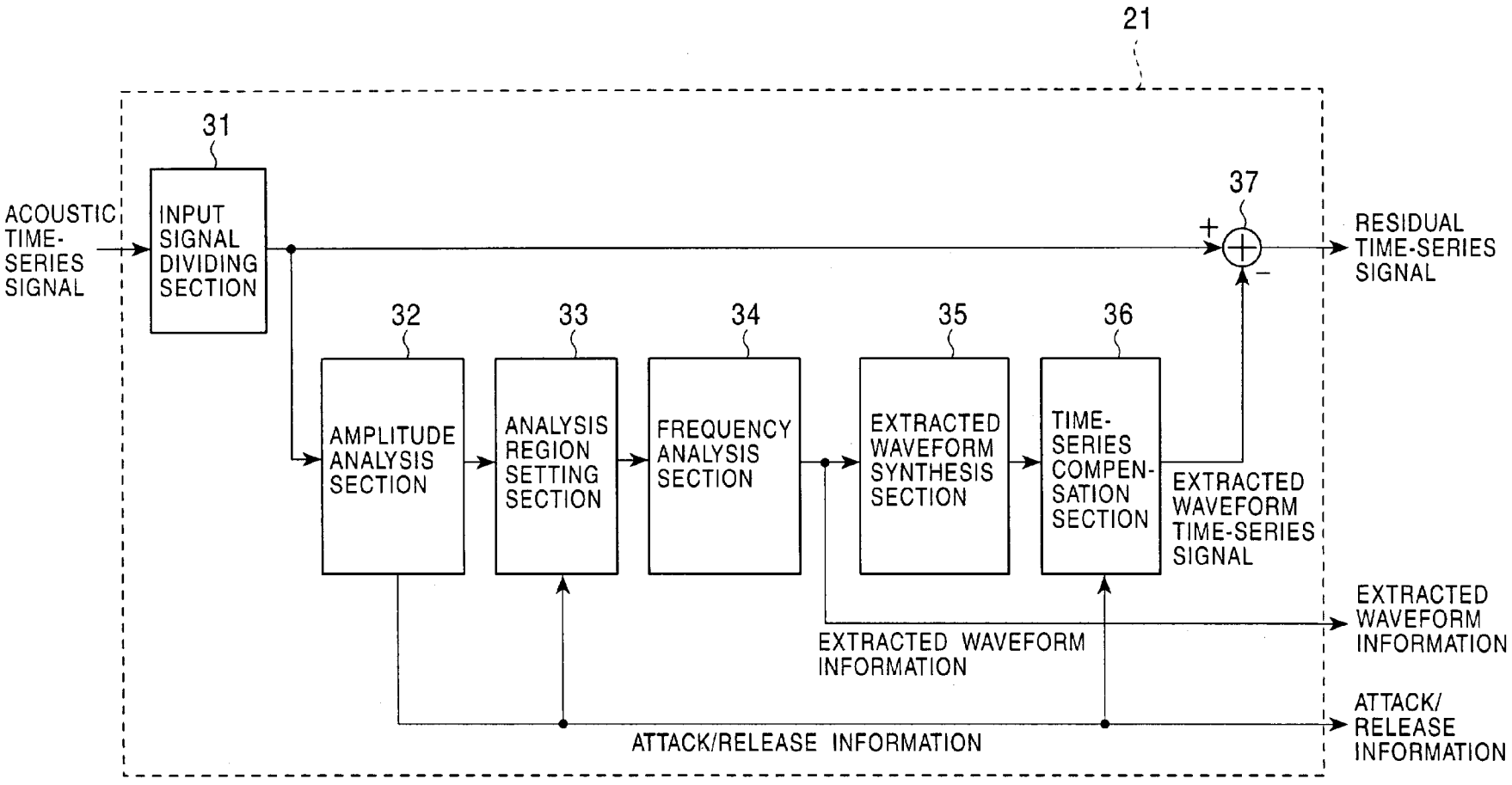
FIG. 4 is a block diagram showing an example of the configuration of a frequency-component extraction apparatus according to the present invention.

FIG. 4 is a block diagram showing an example of the configuration of a frequency-component extraction apparatus according to the present invention.

An input signal dividing section 31 divides, for example, an acoustic time-series signal into predetermined regions when that signal is input as an input signal, and supplies the obtained input time-series signal to a frequency analysis section 32 and a subtraction unit 37.

The frequency analysis section 32 computes an amplitude value for each predetermined small region of an input time-series signal, supplied from the input signal dividing section 31, and determines whether or not the input time-series signal contains an attack or release on the basis of the change in the amplitude value. Furthermore, when an attack or release is detected, the amplitude analysis section 32 creates attack/release information as information on the position where the attack or release has occurred and supplies the information to an analysis region setting section 33, a time-series compensation section 36, and an apparatus (not shown) provided outside the frequency-component extraction apparatus 21.

The analysis region setting section 33 sets a region from an attack position to a release position as an analysis region of the input time-series signal on the basis of the attack/release information supplied from the amplitude analysis section 32. That is, a region where the amplitude value of the input time-series signal does not vary much compared to the amplitude value of the entire input time-series signal is excluded from the analysis region. Furthermore, when the input time-series signal does not contain an attack or release, the region which is divided by the input signal dividing section 31 is assumed to be an analysis region.

The frequency analysis section 34 analyzes the input time-series signal which is supplied by using generalized harmonic analysis, creates extracted waveform information, such as the amplitude or the phase of the main frequency components in the analysis region, and supplies the information to an extracted waveform synthesis section 35 and an apparatus (not shown) provided outside the frequency-component extraction apparatus 21.

The extracted waveform synthesis section 35 performs predetermined waveform synthesis on the basis of a plurality of pieces of extracted waveform information supplied from the frequency analysis section 34 and outputs the obtained extracted waveform time-series signal to a time-series compensation section 36.

The time-series compensation section 36 compensates for the signal in the region excluded from the analysis region by the analysis region setting section 33 on the basis of the attack/release information supplied from the amplitude analysis section 32. That is, since the amplitude value of the signal in a region which does not correspond to the analysis region set by the analysis region setting section 33, within the divided region divided by the input signal dividing section 31, hardly varies while kept to a very small value, the time-series compensation section 36 compensates the amplitude value with a signal at a fixed level, for example, at a "0" level. The extracted waveform time-series signal extending over the entire divided region, generated by the time-series compensation section 36, is output to the subtraction unit 37.

The subtraction unit 37 generates a residual time-series signal on the basis of the extracted waveform time-series signal supplied from the time-series compensation section 36 and the input time-series signal supplied from the input signal dividing section 31, and outputs the signal to an apparatus at a subsequent stage, provided outside the frequency-component extraction apparatus 21.

Figure 5:
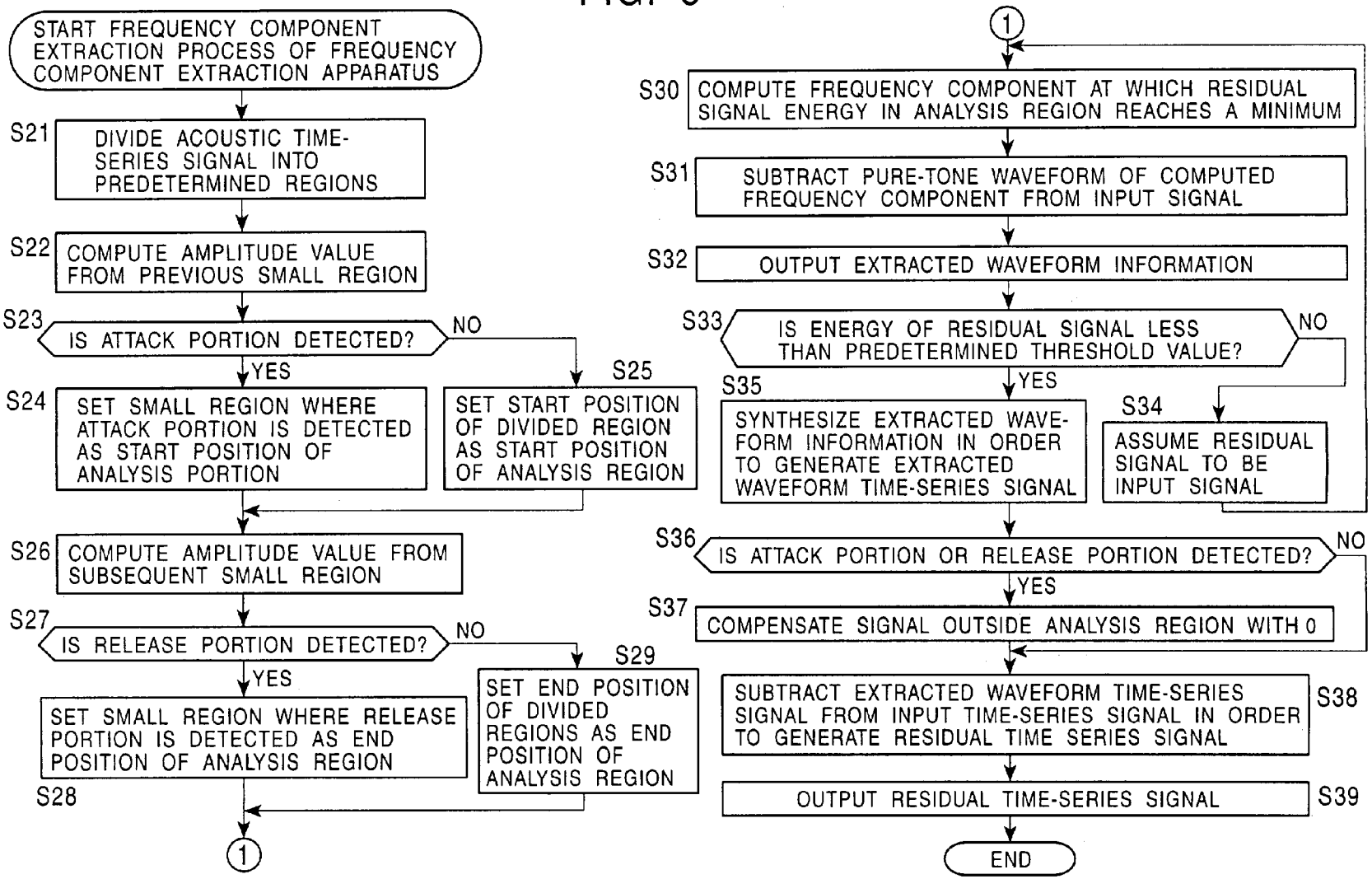
FIG. 5 is a flowchart illustrating processes of the frequency-component extraction apparatus of FIG. 4.
Figure 6A:
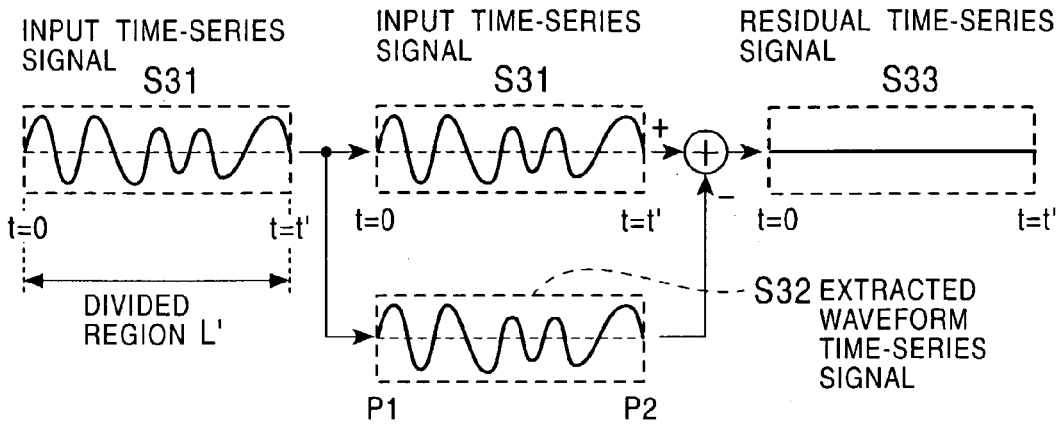
FIG. 6A shows an example of a signal generated by the frequency-component extraction apparatus of FIG. 4.
Figure 6B:
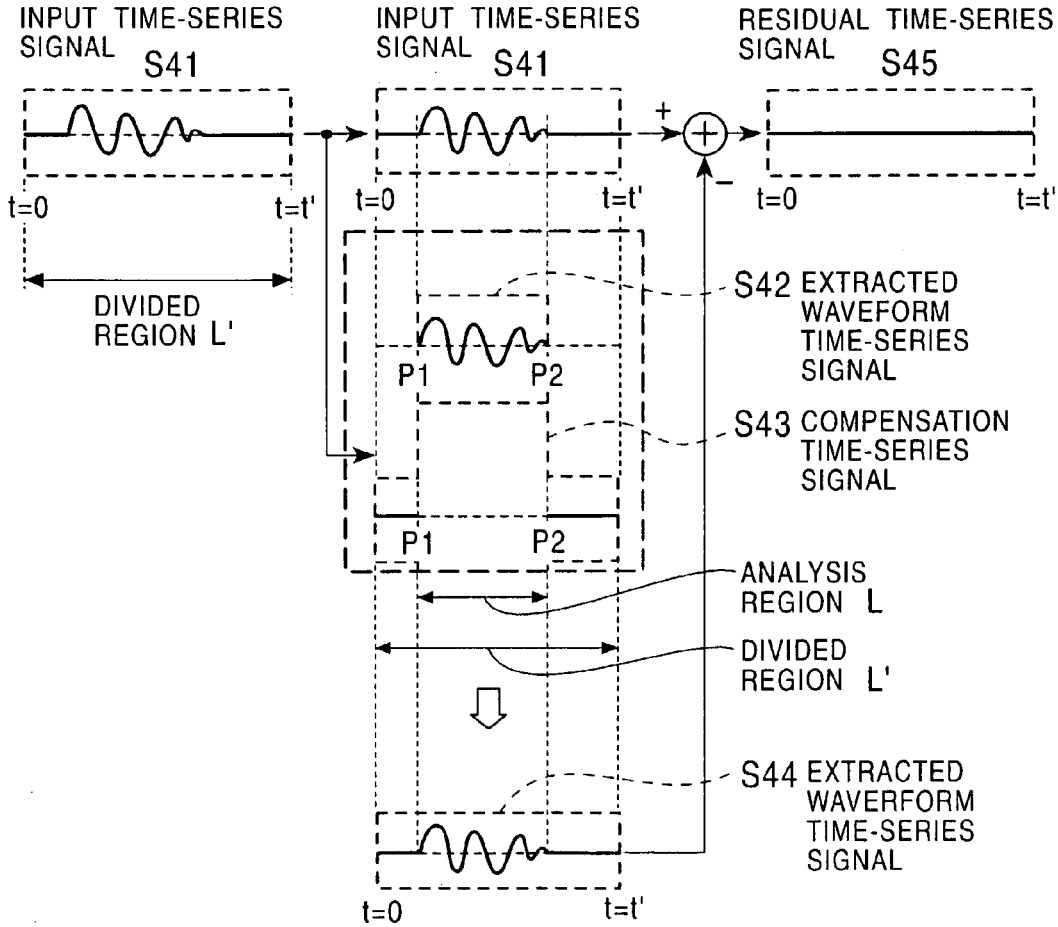
FIG. 6B shows another example of a signal generated by the frequency-component extraction apparatus of FIG. 4.
Figure 7:
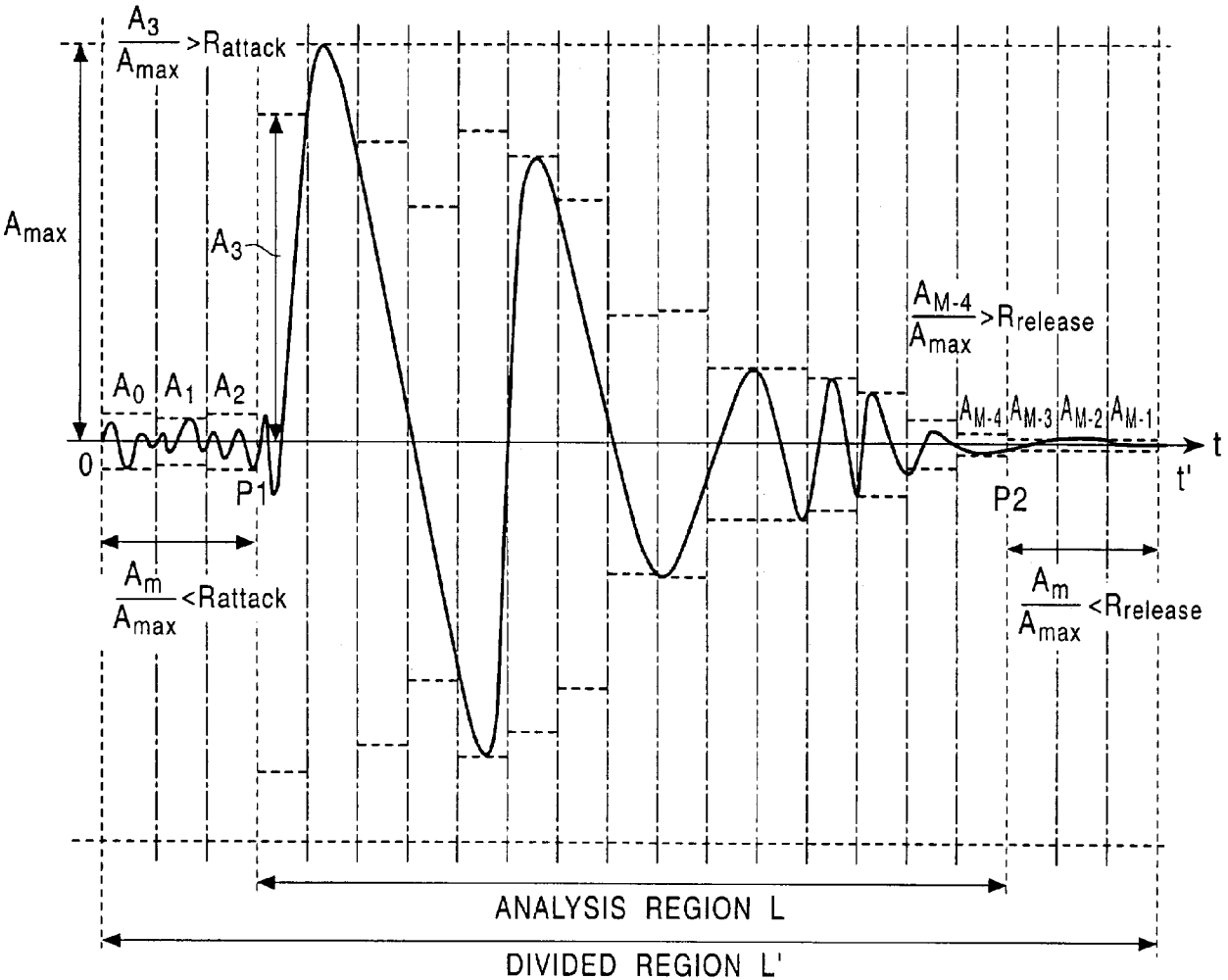
FIG. 7 shows an example of an analysis region set by an analysis region setting section of FIG. 4.

Next, referring to the flowchart in FIG. 5, the operation of the frequency-component extraction apparatus 21 of FIG. 4 is described. Furthermore, in the description, FIGS. 6 and 7 are referred to as appropriate.

In step S21, the input signal dividing section 31 divides an input acoustic time-series signal into predetermined regions, and outputs the generated input time-series signal to the amplitude analysis section 32 and the subtraction unit 37. For example, as shown in FIGS. 6A and 6B, the input signal dividing section 31 divides an acoustic time-series signal at a divided region L' and outputs an input time-series signal s31 or s41 to the amplitude analysis section 32 and the subtraction unit 37. As will be described later, in FIG. 6A (a case in which there is no attack or release), the divided region L' and the analysis region L become the same region, and in FIG. 6B (a case in which there is an attack or release), the divided region L' and the analysis region L become different regions.

In step S22, the amplitude analysis section 32 further divides the input time-series signal which is supplied into smaller regions and computes the amplitude value in each small region in sequence from the previous small region with respect to time. For example, as shown in FIG. 7, the amplitude analysis section 32 divides the input time-series signal into M small regions 0 to M−1 and computes each amplitude value $A_m$ (m=0, 1, 2, . . . , M−1).

In step S23, the amplitude analysis section 32 determines whether or not an attack position is detected by comparing the amplitude value computed in step S22. For example, the amplitude analysis section 32 detects an attack portion in such a way that the maximum amplitude value of the input time-series signal is denoted as $A_{max}$, the ratio of the amplitude value $A_m$ of the m-th small region with respect to $A_{max}$ in the sequence of m=0, 1, 2, . . . , M−1 is computed, and it is determined whether or not the ratio is greater than a ratio $R_{attack}$ which is set in advance when m=0. That is, when a variation of the amplitude value, corresponding to the following equation (1), is detected, the amplitude analysis section 32 determines in step S23 that the attack portion is detected, and the process proceeds to step S24:

$$\frac{A_m}{A_{\max}} \geq R_{attack} \tag{1}$$

The information on the attack position detected by the amplitude analysis section 32 is supplied to the analysis region setting section 33.

In step S24, the analysis region setting section 33 sets a small region where the attack portion is detected as the start position of the analysis region. For example, as shown in FIG. 7, when the ratio of the amplitude value $A_3$ of the small region of m=3 with respect to $A_{max}$ exceeds $R_{attack}$, the analysis region setting section 33 sets the third small region (m=3) as the start position $P_1$ of the analysis region L.

On the other hand, when the amplitude analysis section 32 determines in step S23 that an attack position is not detected, the process proceeds to step S25.

In step S25, the analysis region setting section 33 sets a start position (t=0) of the divided region L' as a start position $P_1$ of the analysis region L.

In step S26, the amplitude analysis section 32 computes the amplitude value in each small region in sequence from the subsequent small regions with respect to time. Then, in step S27, based on the computed result, the amplitude analysis section 32 determines whether or not a release portion is detected. The amplitude analysis section 32 computes, for example, the ratio of the m-th amplitude value $A_m$ with respect to $A_{max}$ in the sequence of m=M−1, M−2, . . . , 0, and determines whether or not the ratio is greater than a ratio $R_{release}$ set in advance when m=M, thereby detecting a release portion. That is, when a variation of the amplitude value corresponding to the following equation (2) is detected, the amplitude analysis section 32 determines in step S27 that a release portion is detected, and the process proceeds to step S28.

$$\frac{A_m}{A_{\max}} \geq R_{release} \tag{2}$$

In step S28, the analysis region setting section 33 sets a small region where a release portion is detected as the end position of the analysis region. For example, as shown in FIG. 7, when the ratio of the amplitude value $A_{M-4}$ of the small region of m=M−4 with respect to $A_{max}$ exceeds $R_{release}$, the analysis region setting section 33 sets the (M−4)-th small region as an end position $P_2$ of the analysis region L. As a result, the region of $P_1$ to $P_2$ within the divided region L' is assumed to be an analysis region L.

On the other hand, when the amplitude analysis section 32 determines in step S27 that a release position is not detected, the process proceeds to step S29.

In step S29, the analysis region setting section 33 sets the end position (t=t') of the divided region L' as an end position $P_2$ of the analysis region L. That is, when there is no attack, the divided region L' and the analysis region L become the same region. The attack/release information is also supplied to the time-series compensation section 36 and an apparatus (not shown) provided outside the frequency-component extraction apparatus 21.

In step S30, when the frequency components are extracted from the input time-series signal, the frequency analysis section 34 computes the frequency components of the input time-series signal at which the energy of the residual signal reaches a minimum. For example, when the input time-series signal is denoted as $x_0(t)$, a residual signal $RS_f(t)$ when the pure-tone waveform of the frequency f is extracted is expressed on the basis of the following equation (3):

$$RS_f(t)=x_0(t)-\{S_f \sin(2\pi ft)+C_f \cos(2\pi ft)\} \tag{3}$$

where $P_1 \leqq t < P_2$.

Furthermore, in equation (3), the amplitude value $S_f$ of the sin term of the analysis region $P_1$ to $P_2$, set by the frequency analysis section 34, is expressed on the basis of the following equation (4), and the amplitude value $C_f$ of the cos term thereof is expressed on the basis of the following equation (5):

$$S_f = \frac{2}{P_2 - P_1}\int_{P_1}^{P_2} x_0(t)\sin(2\pi f t)dt \tag{4}$$

$$C_f = \frac{2}{P_2 - P_1}\int_{P_1}^{P_2} x_0(t)\cos(2\pi f t)dt \quad (5)$$

In addition, a residual signal energy $E_f$ of the residual signal $RS_f(t)$ expressed by equation (3) is expressed on the basis of the following equation (6):

$$E_f = \int_{P_1}^{P_2} RS_f(t)^2 dt \quad (6)$$

More specifically, in step S30, the frequency analysis section 34 computes the residual signal energy $E_f$ with respect to all the frequencies of the analysis region on the basis of equation (6) and compares the respective values, thereby obtaining a frequency $f_1$ at which the residual signal energy $E_f$ reaches a minimum.

In step S31, the frequency analysis section 34 subtracts the pure-tone waveform corresponding to the frequency $f_1$ obtained in step S30 from the input time-series signal $x_0(t)$ in order to generate a residual signal. That is, the frequency analysis section 34 generates a residual signal $x_1(t)$ on the basis of the following equation (7):

$$x_1(t)=x_0(t)-\{S_{f1}\sin(2\pi f_1 t)+C_{f1}\cos(2\pi f_1 t)\} \quad (7)$$

Furthermore, the frequency analysis section 34 computes, based on equations (4) and (5) described above, the amplitude value $S_{f1}$ of the sin term and the amplitude value $C_{f1}$ of the cos term of equation (3), corresponding to the frequency $f_1$, in order to create extracted waveform information. Furthermore, the extracted waveform information which is created may contain an amplitude value $A_{f1}$ and a phase $P_{f1}$ of the frequency $f_1$, computed on the basis of equations (8), (9), and (10):

$$S_{f1}\sin(2\pi f_1 t)+C_{f1}\cos(2\pi f_1 t)=A_{f1}\sin(2\pi f_1 t+P_{f1}) \quad (8)$$

$$A_{f1}=\sqrt{S_{f_i}^2+C_{f1}^2} \quad (9)$$

$$P_{fl} = \arctan\left(\frac{C_{fl}}{S_{fl}}\right) \quad (10)$$

The extracted waveform information computed on the basis of the above-described equations is supplied to the extracted waveform synthesis section 35 in step S32.

In step S33, the frequency analysis section 34 computes the residual energy of the residual signal $x_1(t)$ shown in equation (7) and determines whether or not the residual energy is less than a predetermined threshold value. For example, the frequency analysis section 34 determines whether or not the residual energy of the residual signal $x_1(t)$ is less than a threshold value such that the signal energy of the input time-series signal is subtracted by X(dB).

When it is determined in step S33 that the residual energy $E_{f1}$ of the residual signal $x_1(t)$ is greater than the predetermined threshold value, the frequency analysis section 34 proceeds to step S34, where the residual signal $x_1(t)$ is assumed to be the input time-series signal $x_0(t)$, and the process returns to step S30, and the above-described processes are repeated. That is, the extracted waveform information created by the frequency analysis section 34 is supplied repeatedly to the extracted waveform synthesis section 35. The number of times in which the processes of steps S30 to S34 are repeatedly performed is set to be a fixed number of times which is set in advance, and when the number of times which is set in advance is reached, the process may proceed to step S35.

On the other hand, when it is determined in step S33 that the residual energy $E_{f1}$ of the residual signal $x_1(t)$ is less than the predetermined threshold value, the frequency analysis section 34 proceeds to step S35.

In step S35, the extracted waveform synthesis section 35 performs a predetermined synthesis process on the basis of a plurality of pieces of extracted waveform information supplied from the frequency analysis section 34 in order to generate an extracted waveform time-series signal of the analysis region. When, for example, N pieces of extracted waveform information are supplied, the extracted waveform synthesis section 13 generates an extracted waveform time-series signal E'S(t) on the basis of the following equation (11):

$$E'S(t) = \sum_{n=0}^{N}\{S_{f_n}\sin(2\pi f_n t) + C_{f_n}\cos(2\pi f_n t)\} \quad (11)$$

More specifically, when the input time-series signal contains an attack or release, as shown in FIG. 6B, an extracted waveform time-series signal s42 in the analysis region L (the region from the attack to the release) is generated by the extracted waveform synthesis section 35. Furthermore, when the input time-series signal does not contain an attack or release, as shown in FIG. 6A, an extracted waveform time-series signal s32 in the same region as that of the input time-series signal s31 is generated.

The generated extracted waveform time-series signal E'S (t) is supplied to the time-series compensation section 36. In step S36, it is determined whether or not an attack portion or a release portion is detected. When it is determined that an attack portion or a release portion is detected, the process proceeds to step S37.

In step S37, the time-series compensation section 36 compensates the signal outside the analysis region of the extracted waveform time-series signal with a signal of, for example, a "0" level, and the extracted waveform time-series signal of the entire divided region is generated. When the input time-series signal contains an attack or release, as shown in FIG. 6B, the signal outside the analysis region (the region of t=0 to t=$P_1$ and the region of t=$P_2$ to t =t') is compensated with a compensation time-series signal s43, and an extracted waveform time-series signal s44 is generated. The generated extracted waveform time-series signal s44 is shown by the following equation (12):

$$ES(t) = \begin{cases} 0 & (0 \le t < P_1) \\ E'S(t) & (P_1 \le t < P_2) \\ 0 & (P_2 \le t < t') \end{cases} \quad (12)$$

Furthermore, in the analysis region L ($P_1$ to $P_2$), a non-continuous point sometimes occurs in the extracted waveform time-series signal s42. In contrast, in the extracted waveform synthesis section 35, a non-continuous point may be avoided by gradually varying the amplitude value of a signal by multiplying with a function in a short region. In this case, the extracted waveform time-series signal s44 is shown on the basis of the following equation (13):

$$ES(t) = \begin{cases} 0 & (0 \le t < P_1) \\ \frac{1}{K} k \cdot E'S(t) & (P_1 \le t < P_1 + K) \\ E'S(t) & (P_1 + K \le t < P_2 - K) \\ \frac{1}{K} k \cdot E'S(t) & (P_2 - K \le t < P_2) \\ 0 & (P_2 \le t < t') \end{cases} \quad (13)$$

where K is assumed to be sufficiently smaller with respect to L.

The extracted waveform time-series signal generated by the time-series compensation section 36 is output to the subtraction unit 37.

On the other hand, when the time-series compensation section 36 determines in step S36 that the input time-series signal does not contain an attack portion or a release portion, the process of step S37 is skipped, the signal is not compensated for, and the extracted waveform time-series signal s32, such as that shown in FIG. 6A, in the same region as that of the input time-series signal s31, is output to the subtraction unit 37.

In step S38, the subtraction unit 37 generates a residual time-series signal RS(t) on the basis of the input time-series signal supplied from the input signal dividing section 31 and the extracted waveform time-series signal supplied from the time-series compensation section 36. The residual time-series signal RS(t) is shown by the following equation (14):

$$\mathrm{RS}(t)=x_0(t)-\mathrm{ES}(t) \quad (14)$$

In step S39, the residual time-series signal RS(t) generated in step S38 is output to an apparatus (not shown) provided outside the frequency-component extraction apparatus 21.

By setting an analysis region and performing frequency analysis in this manner, even for an input time-series signal in which an attack portion or a release portion is contained, a residual time-series signal such as that shown in a residual time-series signal s45 of FIG. 6B can be supplied to an apparatus at a subsequent stage. That is, the input acoustic time-series signal can be analyzed with accuracy and high efficiency.

Figure 8:
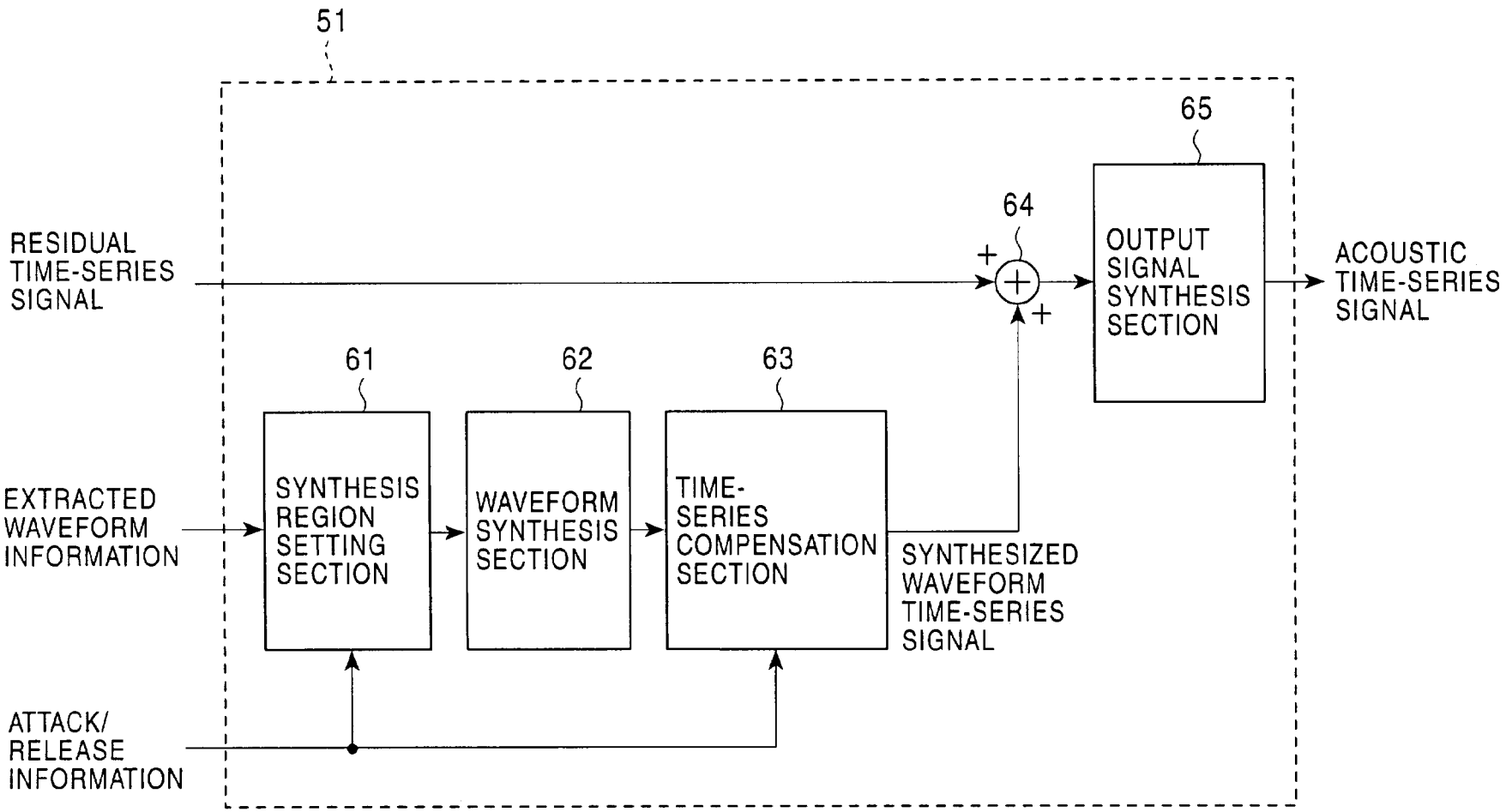
FIG. 8 is a block diagram showing an example of the configuration of a frequency-component synthesis apparatus according to the present invention.

FIG. 8 is a block diagram showing an example of the configuration of a frequency-component synthesis apparatus 51 for reproducing an acoustic time-series signal on the basis of various types of information created by the frequency-component extraction apparatus 21.

A synthesis region setting section 61 sets a region (synthesis region) of a waveform synthesis process performed by a waveform synthesis section 62 at a subsequent stage on the basis of the extracted waveform information supplied from the frequency-component extraction apparatus 21, and attack/release information.

The waveform synthesis section 62 performs, on the basis of extracted waveform information, waveform synthesis in a synthesis region set by the synthesis region setting section 61 and supplies the generated synthesized waveform time-series signal to a time-series compensation section 63.

The time-series compensation section 63 compensates, as appropriate, the supplied synthesized waveform time-series signal with a signal outside the synthesis region on the basis of the supplied attack/release information.

An adder 64 adds the residual time-series signal supplied from the frequency-component extraction apparatus 21 and the synthesized waveform time-series signal supplied from the time-series compensation section 63 together, and outputs the generated synthesized waveform time-series signal of a predetermined region to an output signal synthesis section 65.

The output signal synthesis section 65 synthesizes a plurality of synthesized waveform time-series signals in a predetermined region, supplied from the adder 64, in order to reproduce an acoustic time-series signal, and outputs the signal to an apparatus outside a frequency-component synthesis apparatus 51.

Figure 9:
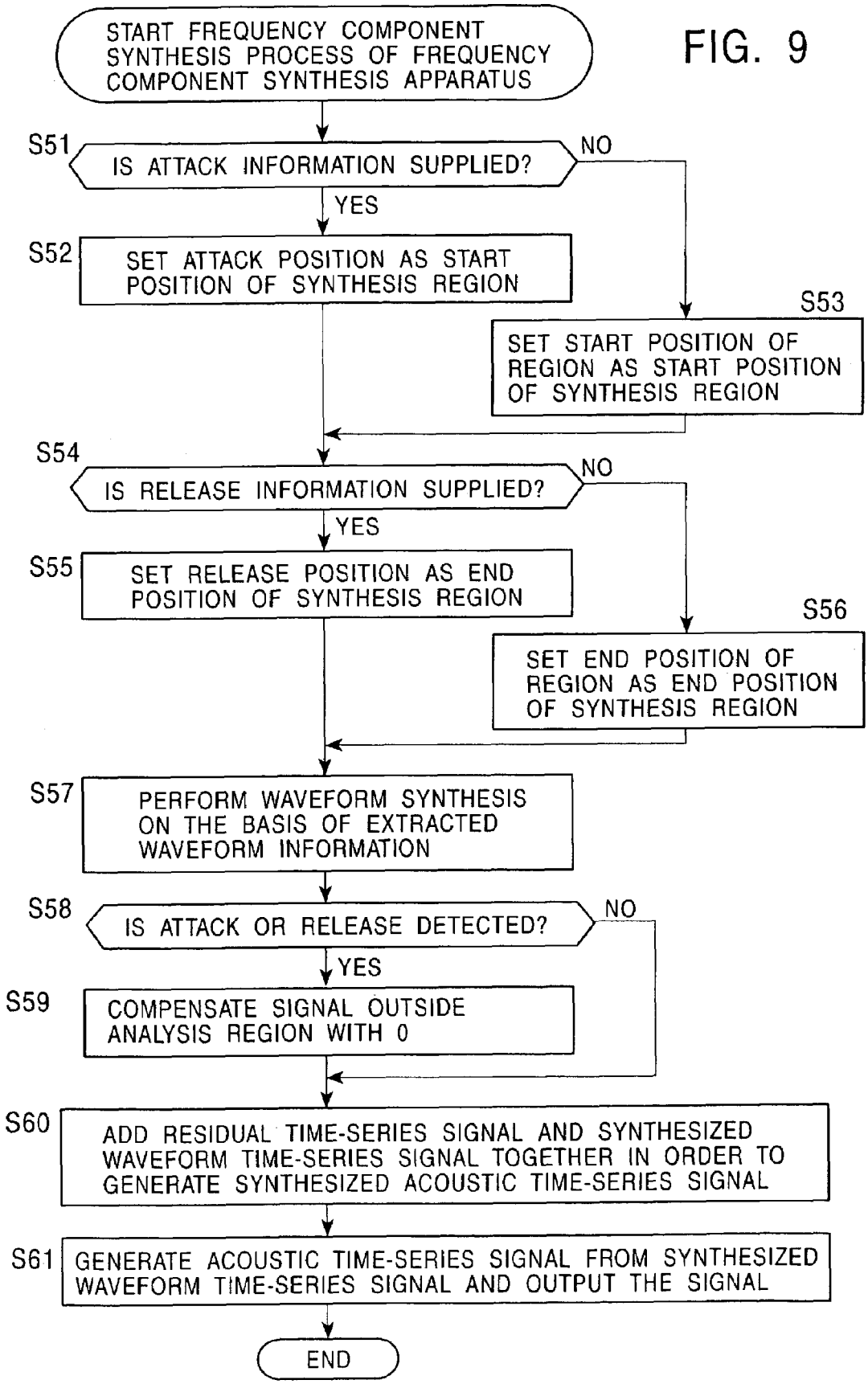
FIG. 9 is a flowchart illustrating processes of the frequency-component synthesis apparatus of FIG. 8.
Figure 10A:
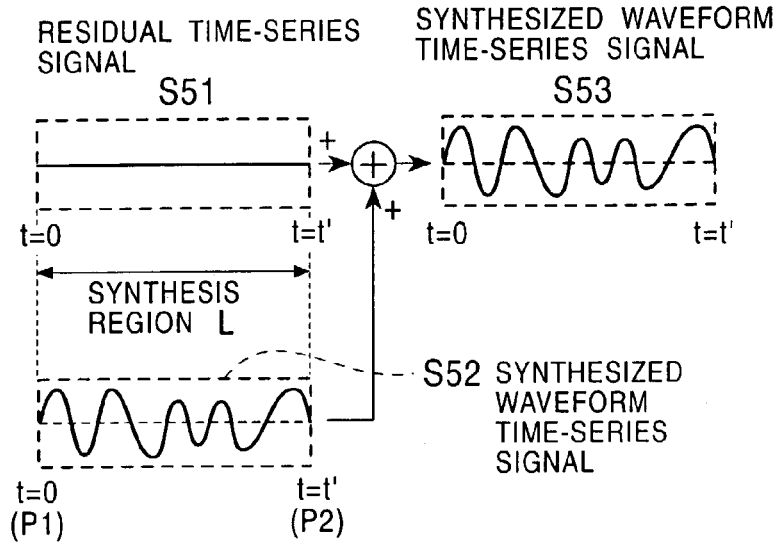
FIG. 10A shows an example of a signal generated by the frequency-component synthesis apparatus of FIG. 8.
Figure 10B:
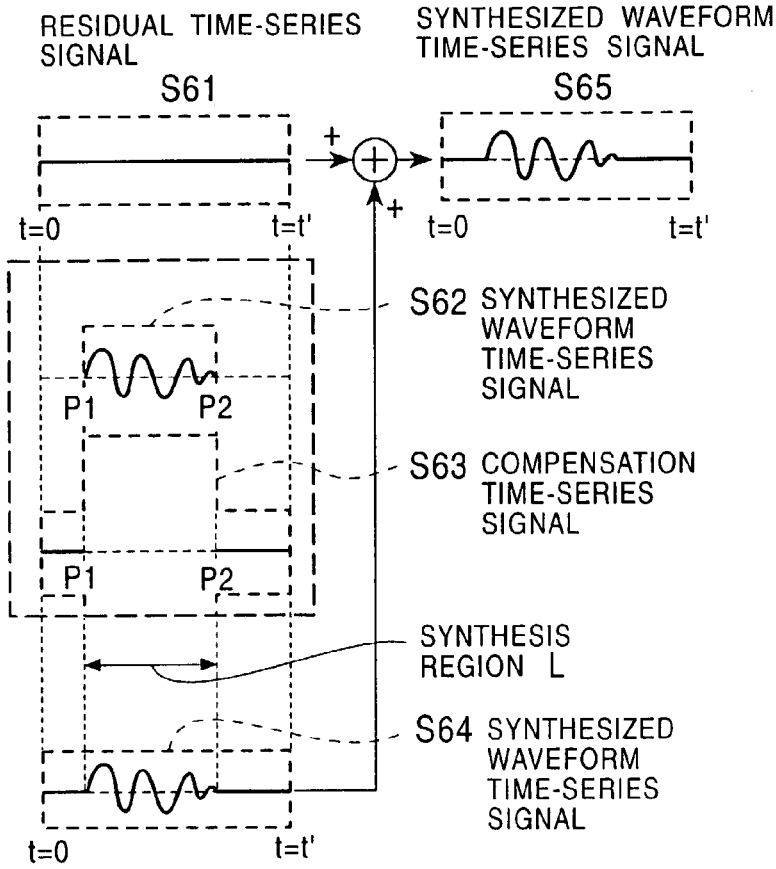
FIG. 10B shows another example of a signal generated by the frequency-component synthesis apparatus of FIG. 8.

Next, referring to the flowchart in FIG. 9, the operation of the frequency-component synthesis apparatus 51 of FIG. 8 is described. Furthermore, in the description, FIGS. 10A and 10B are referred to as appropriate.

In step S51, the synthesis region setting section 61 determines whether or not attack information is supplied from the frequency-component extraction apparatus 21. When it is determined that attack information is supplied, the process proceeds to step S52.

In step S52, the synthesis region setting section 61 sets an attack position as the start position of the synthesis region on the basis of the supplied attack information. For example, as shown in FIG. 10B, when a predetermined region when the extracted waveform information is synthesized is assumed to be from t=0 to t=t', the start position of the synthesis region L is set as $P_1$.

On the other hand, when the synthesis region setting section 61 determines in step S52 that attack information is not supplied, the process proceeds to step S53, where the start position of the region is set as the start position of the synthesis region. For example, as shown in FIG. 10A, the start position of the predetermined region when the extracted waveform information is synthesized and the start position $P_1$ of the synthesis region L are the same.

In step S54, the synthesis region setting section 61 determines whether or not release information is supplied from the frequency-component extraction apparatus 21. When it is determined that release information is supplied, the process proceeds to step S55.

In step S55, the synthesis region setting section 61 sets the release position as the end position of the synthesis region on the basis of the supplied release information. For example, as shown in FIG. 10B, the end position of the synthesis region L is set as $P_2$. As a result, the region of $P_1$ to $P_2$ is set as a synthesis region L.

On the other hand, when the synthesis region setting section 61 determines in step S54 that release information is not supplied, the process proceeds to step S56, where the end position of the region is set as the end position of the synthesis region. For example, as shown in FIG. 10A, the end position of the synthesis region L is set as $P_2$.

In step S57, the waveform synthesis section 62 synthesizes the supplied extracted waveform information on the basis of the synthesis region set by the synthesis region setting section 61 in order to generate a synthesized waveform time-series signal of the synthesis region. The extracted waveform information supplied to the waveform synthesis section 62 is, for example, waveform information of N frequency components, and is shown by equations (8), (9), and (10) described above. That is, the waveform synthesis section 62 synthesizes the extracted waveform information shown by these equations on the basis of the following equation (15) in order to generate a synthesized waveform time-series signal:

$$E'S(t) = \sum_{n=0}^{N} \{S_{f_n} \sin(2\pi f_n t) + C_{f_n} \cos(2\pi f_n t)\} \quad (15)$$

where $P_1 \leqq t < P_2$.

When, for example, attack/release information is not supplied, as shown in FIG. 10A, a synthesized waveform time-series signal s52 of the synthesis region L is generated. When attack/release information is supplied, as shown in FIG. 10B, a synthesized waveform time-series signal s62 of the synthesis region L of $P_1$ to $P_2$ is generated. The synthesized waveform time-series signal of the synthesis region, generated in step S57, is supplied to the time-series compensation section 63.

In step S58, the time-series compensation section 63 determines whether or not the synthesized waveform time-series signal contains an attack or release on the basis of the attack/release information supplied from the frequency-component extraction apparatus 21.

When the time-series compensation section 63 determines inn step S58 that an attack or release is contained in the synthesized waveform time-series signal, the process proceeds to step S59, where the signal outside the synthesis region is compensated with a signal at, for example, a "0" level. That is, as shown in FIG. 10B, a signal outside the synthesis region (the region from t=0 to $t=P_1$ and from $t=P_2$ to t=t') is assumed to be a compensation time-series signal s63, this signal is compensated with the synthesized waveform time-series signal s62, and a synthesized waveform time-series signal s64 is generated.

When it is determined in step S58 that an attack or release is not contained in the synthesized waveform time-series signal, the process of step S59 is skipped, and the process proceeds to step S60.

The compensated synthesized waveform time-series signal is supplied to the adder 64, and in step S60, the signal is added with the residual signal supplied from the frequency-component extraction apparatus 21. That is, synthesized waveform time-series signals s53 and s63, such as those shown in FIGS. 10A and 10B, are generated.

In step S61, an output signal synthesis section 65 synthesizes a plurality of synthesized waveform time-series signals supplied from the adder 64 in order to generate an acoustic time-series signal, and outputs the signal to an apparatus (not shown) provided outside the frequency-component synthesis apparatus 51. It is possible for the above-described processes to reproduce a signal corresponding to the acoustic time-series signal processed by the frequency-component extraction apparatus 21.

Figure 11:
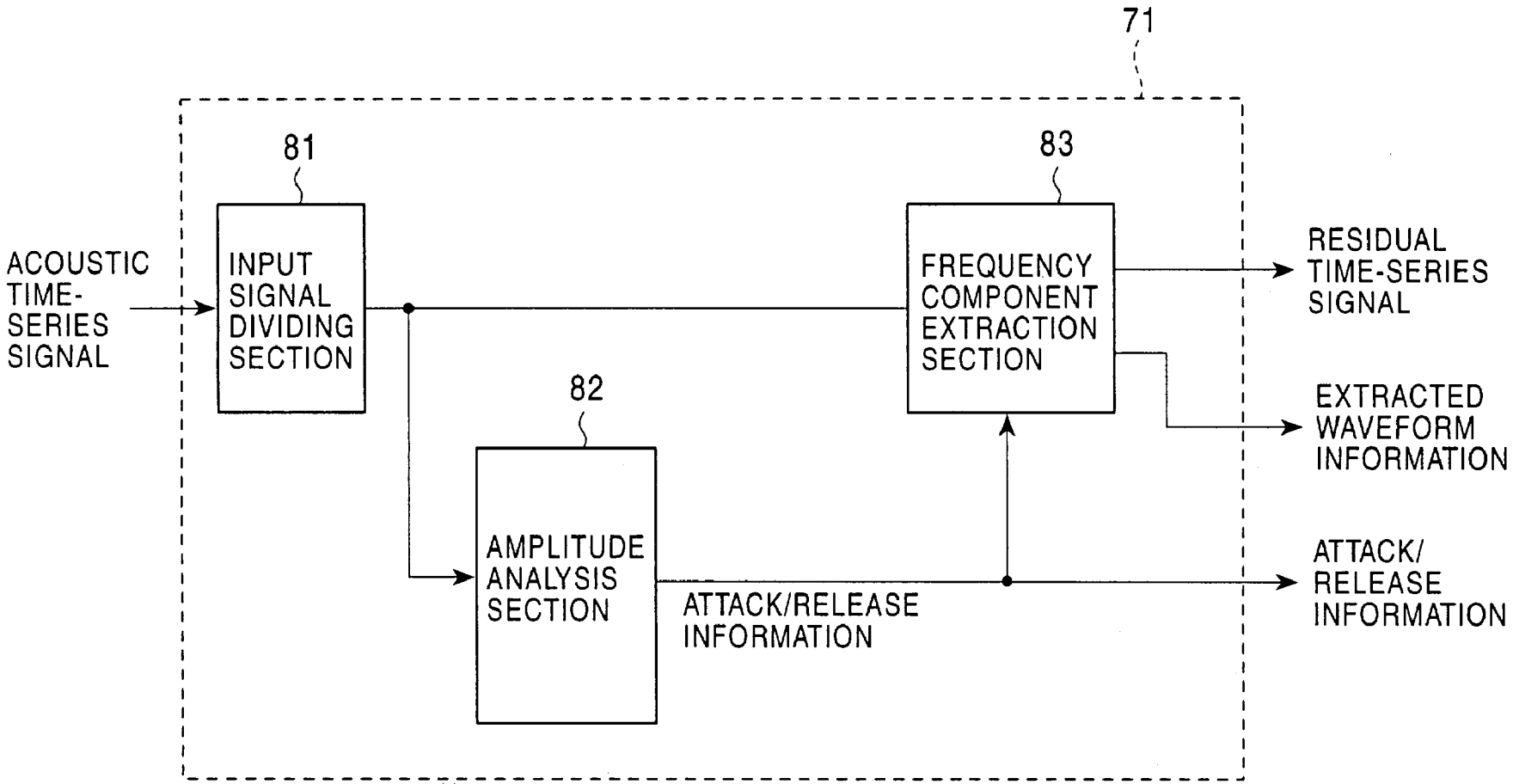
FIG. 11 is a block diagram showing another example of the configuration of a frequency-component extraction apparatus according to the present invention.
Figure 12:
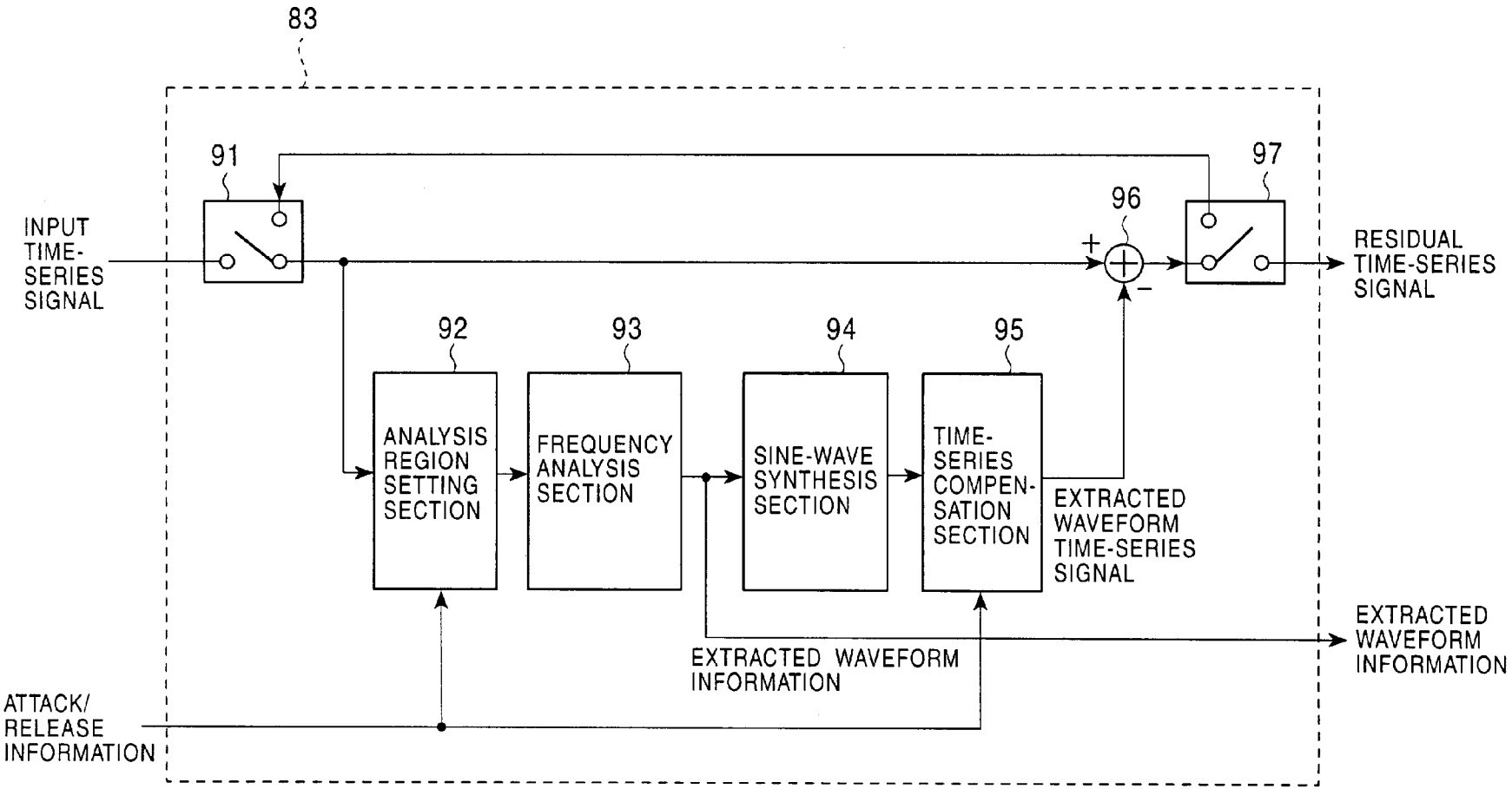
FIG. 12 is a block diagram showing an example of the configuration of the frequency-component extraction section of FIG. 11.

FIGS. 11 and 12 are block diagrams showing another example of the configuration of the frequency-component extraction apparatus according to the present invention. That is, since generalized harmonic analysis is used to extract frequency components one by one, the frequency-component extraction apparatus 21 shown in FIG. 4 can also be configured as shown in FIGS. 11 and 12.

In FIG. 11, an input signal dividing section 81 divides, for example, an acoustic time-series signal into predetermined regions when that signal is input as an input signal, and supplies the obtained input time-series signal to an amplitude analysis section 82 and a frequency-component extraction section 83.

The amplitude analysis section 82 computes the amplitude value for each predetermined small region of the input time-series signal supplied from the input signal dividing section 81, and determines whether or not the input time-series signal contains an attack or release on the basis of the variation of the amplitude value. The amplitude analysis section 82 creates attack/release information as information on the position of the detected attack or release, and outputs the information to the frequency-component extraction section 83 and an apparatus (not shown) provided outside a frequency-component extraction apparatus 71.

The frequency-component extraction section 83 extracts frequency components by generalized harmonic analysis on the basis of the supplied input time-series signal and attack/release information, generates a residual time-series signal and extracted waveform information, and outputs these to an apparatus at a subsequent stage.

FIG. 12 is a block diagram showing a detailed example of the configuration of the frequency-component extraction apparatus 83.

A switch 91 switches contact points in accordance with an instruction from a residual energy determination section 97, so that an input time-series signal, which is processed by a series of sections from an analysis region setting section 92 to a subtraction unit 96, is selected.

The analysis region setting section 92 sets a region from the attack position to the release position as an analysis region of the input time-series signal on the basis of the attack/release information supplied from the amplitude analysis section 82. Furthermore, when an attack or release is not contained in the input time-series signal, the region divided by the input signal dividing section 81 is used as an analysis region.

The frequency analysis section 93 analyzes the supplied input time-series signal by using generalized harmonic analysis in order to compute frequency components at which the residual energy reaches a minimum from the input time-series signal when the signal is extracted. Furthermore, the frequency analysis section 93 outputs the extracted waveform information corresponding to the computed frequency components to the sine-wave synthesis section 94 and an apparatus (not shown) provided outside the frequency-component extraction apparatus 71.

The sine-wave synthesis section 94 performs predetermined waveform synthesis on the basis of the extracted waveform information supplied from the frequency analysis section 93 and outputs the obtained extracted waveform time-series signal to the time-series compensation section 95.

The time-series compensation section 95 compensates the extracted waveform time-series signal supplied from the sine-wave synthesis section 94 with a signal on the basis of the attack/release information supplied from the amplitude analysis section 82, and outputs the obtained signal to the subtraction unit 96.

The subtraction unit 96 generates a residual time-series signal from the difference between the input time-series signal supplied from the switch 91 and the extracted waveform time-series signal supplied from the time-series compensation section 95, and outputs the signal to the residual energy determination section 97.

The residual energy determination section 97 computes the residual energy of the residual time-series signal, and switches, as appropriate, a built-in switch so that the residual time-series signal is output to the switch 91 or an apparatus outside the frequency-component extraction apparatus 71.

Figure 13:
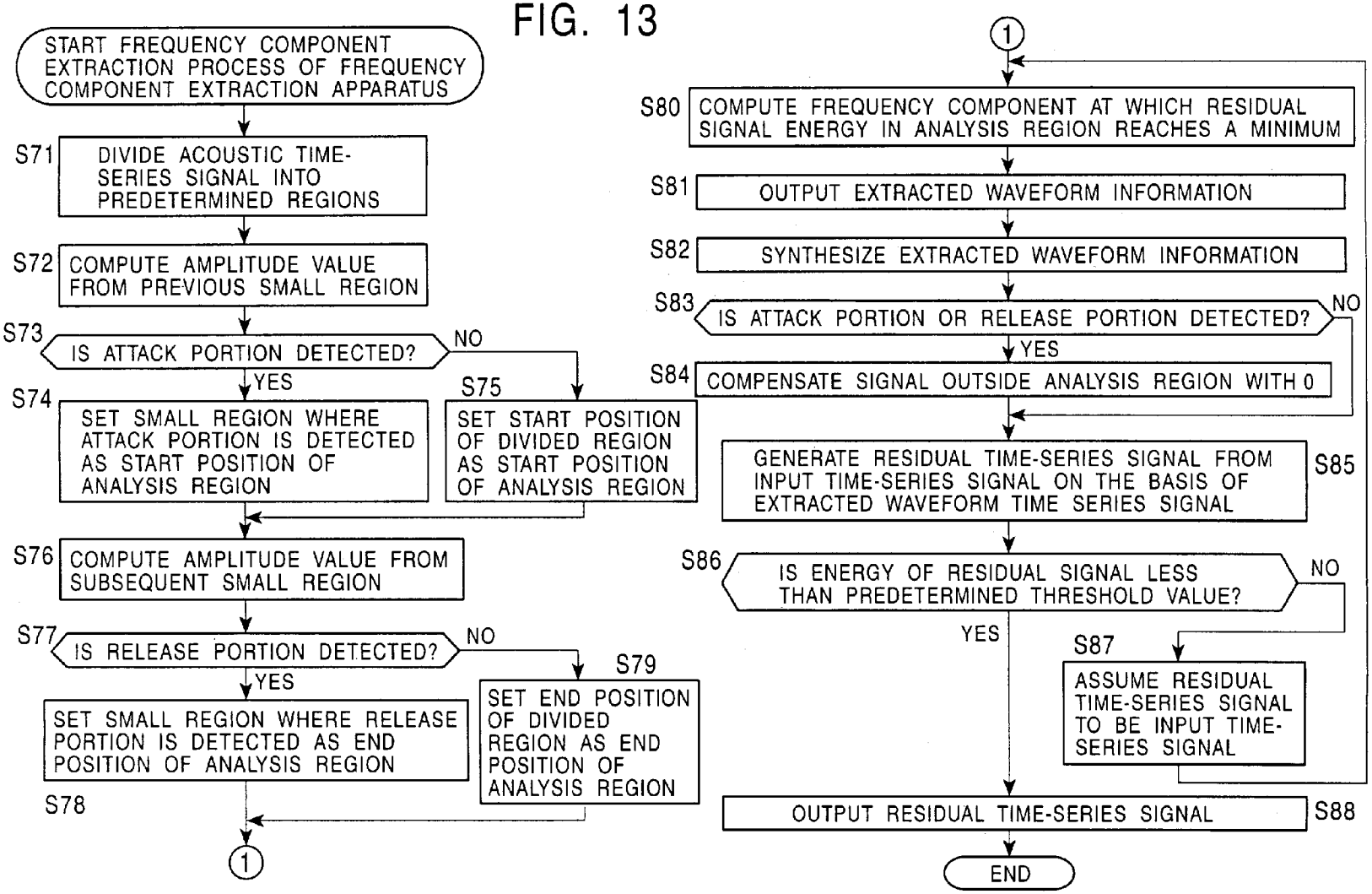
FIG. 13 is a flowchart illustrating processes of the frequency-component synthesis apparatus of FIG. 11.

Next, referring to the flowchart in FIG. 13, the operation of the frequency-component extraction apparatus 71 of FIG. 11 is described.

The processes of steps S71 to S79 are basically the same as the processes of steps S21 to S29 described with reference to FIG. 4. That is, the input time-series signal divided by the input signal dividing section 81 in step S71 is supplied to the amplitude analysis section 82, where it is detected whether or not an attack or release is contained in the input time-series signal. When an attack or release is detected, a region from the attack position to the release position is set as an analysis region of the frequency components by the analysis region setting section 92, and the analysis region is reported to the frequency analysis section 93. Furthermore, when an attack or release is not detected, the region divided by the input signal dividing section 81 is set as an analysis region.

In step S80, the frequency analysis section 93 computes, based on the analysis region set by the analysis region setting section 92, the frequency components at which the energy of the residual signal when the frequency components are subtracted from the input time-series signal reaches a minimum.

In step S81, the frequency analysis section 93 supplies the extracted waveform information created from the waveform information of the frequency components computed in step S80 to the sine-wave synthesis section 94. In step S82, the sine-wave synthesis section 94 synthesizes the supplied extracted waveform information.

The time-series compensation section 95 determines whether or not the input time-series signal contains an attack or release on the basis of the attack/release information supplied from the amplitude analysis section 82. When it is determined that an attack or release is contained, in step S84, in the manner described above, the time-series compensation section 95 compensates the signal outside the analysis region with a signal at a "0" level. The generated extracted waveform time-series signal is supplied to the subtraction unit 96.

On the other hand, when it is determined in step S83 that the input time-series signal does not contain an attack or release, the process of step S84 is skipped.

In step S85, the subtraction unit 96 generates a residual time-series signal on the basis of the input time-series signal supplied from the switch 91 and the extracted waveform time-series signal supplied from the time-series compensation section 95, and outputs the signal to the residual energy determination section 97.

In step S86, the residual energy determination section 97 computes the energy of the supplied residual time-series signal on the basis of equation (6) described above and determines whether or not the energy is less than a predetermined threshold value.

When it is determined in step S86 that the residual energy is greater than the predetermined threshold value, in step S87, the residual energy determination section 97 controls the built-in switch and the switch 91 so that the residual time-series signal is assumed to be an input time-series signal and feeds this signal back to the analysis region setting section 92. Thereafter, the process returns to step S80, where this and subsequent processes are repeatedly performed.

On the other hand, when it is determined in step S86 that the residual energy is less than the predetermined threshold value, in step S88, the residual time-series signal is output to an apparatus outside the frequency-component extraction apparatus 71.

With such a construction, similarly to the frequency-component extraction apparatus 21 of FIG. 4, the input acoustic time-series signal can be analyzed with accuracy and high efficiency.

In the foregoing description, the value which is used for compensation in the time-series compensation section is set to, for example, 0. However, compensation with a signal at a fixed level is also possible. Furthermore, in the analysis region setting section, one analysis region is set within one divided region. However, a plurality of divided regions may be provided. In addition, information from the extraction apparatus of the present invention may be compressed and then coded so that a code sequence is stored in a recording medium or is transmitted through a transmission line. This code sequence may be read from a recording medium or may be received through a transmission line and then decoded, so that a signal corresponding to an input signal is reproduced by using a synthesis apparatus of the present invention.

The present invention can be applied to various audio apparatuses, voice recognition apparatuses, speech synthesis apparatuses, etc., for processing an audio signal.

Although the above-described series of processes can be performed by hardware, these can also be performed by software. In this case, for example, the frequency-component extraction apparatuses 21 and 71, and the frequency-component synthesis apparatus 51 are formed by a personal computer such as that shown in FIG. 14.

Figure 14:
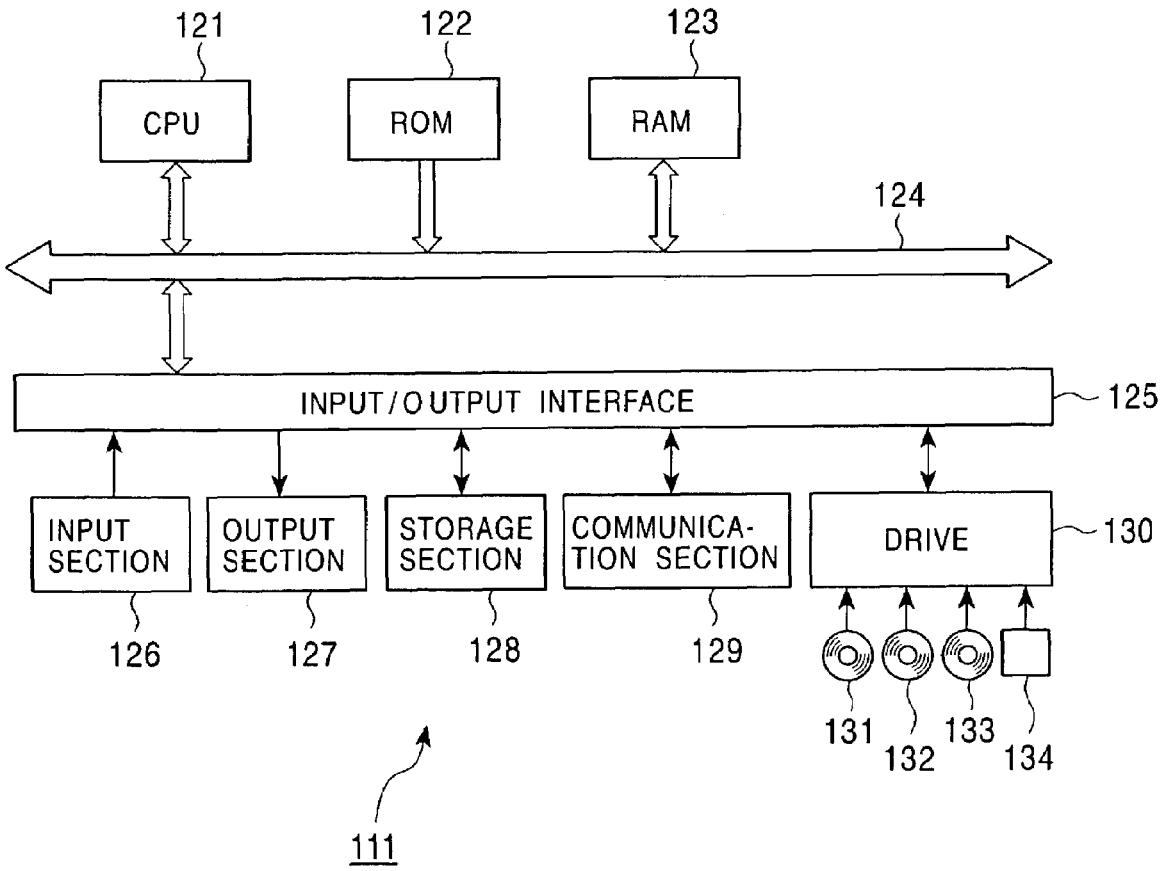
FIG. 14 is a block diagram showing an example of the configuration of a personal computer.

In FIG. 14, a CPU (Central Processing Unit) 121 performs various processes in accordance with a program stored in a ROM (Read Only Memory) 122 or loaded into a RAM (Random Access Memory) 123 from a storage section 128. Also, in the RAM 123, data required for the CPU 121 to perform various processes is stored as appropriate.

The CPU 121, the ROM 122, and the RAM 123 are connected to each other via a bus 124. Furthermore, an input/output interface 125 is connected to the bus 124.

An input section 126 formed of a keyboard, a mouse, etc.; an output section 127 formed of a display made of a CRT, an LCD or the like, and a speaker, etc.; a storage section 128 formed of a hard disk, etc.; and a communication section 129 formed of a modem, a terminal adaptor, etc., are connected to the input/output interface 125. The communication section 129 performs a communication process via a network.

Furthermore, a drive 130 is connected as necessary to the input/output interface 125. A magnetic disk 131, an optical disk 132, a magneto-optical disk 133, or a semiconductor memory 134 is loaded to the drive 130 as appropriate. A computer program read therefrom is installed into the storage section 128 as necessary.

When a series of processes is to be performed by software, programs which form the software are installed into a computer incorporated into dedicated hardware or, for example, are installed into a general-purpose personal computer 111 capable of performing various functions by installing various programs through a network or from a recording medium.

As shown in FIG. 14, this recording medium is constructed by not only packaged media formed of the magnetic disk 131 (including a floppy disk), the optical disk 132 (including a CD-ROM (Compact Disk-Read Only Memory) and a DVD (Digital Versatile Disk)), the magneto-optical disk 133 (including an MD (Mini-Disk)), or the semiconductor memory 134, in which programs are recorded and which is distributed separately from the main unit of the apparatus so as to distribute programs to a user, but also is constructed by the ROM 122, a hard disk contained in the storage section 128, etc., in which programs are recorded and which is distributed to a user in a state in which it is incorporated in advance into the main unit of the apparatus.

In this specification, steps which describe a program recorded on a recording medium contain not only processes performed in a time-series manner along the described sequence, but also processes performed in parallel or individually although the processes are not necessarily performed in a time-series manner.

INDUSTRIAL APPLICABILITY

As has thus been described, according to the present invention, frequency components can be extracted with accuracy and high efficiency. Furthermore, according to the present invention, frequency components which are analyzed with accuracy and high efficiency can be synthesized, and a signal corresponding to an input signal can be reproduced.

The invention of claimed is:

1. An information extraction apparatus comprising:

an input signal dividing unit for dividing an input signal into predetermined regions;

an amplitude-value analyzing unit for computing an amplitude value for each one of said predetermined regions of said input signal divided by said input signal dividing unit, and determining whether or not the predetermined region contain an attack or a release on the basis of a change in the amplitude value;

an analysis region setting unit for setting an analysis region within the predetermined region once when the attack or release is determined to be within the predetermined region by said amplitude-value analyzing unit;

a waveform information extraction unit for extracting waveform information of said input signal of said analysis region set by said analysis region setting unit;

a synthesized waveform generation unit for generating a synthesized waveform on the basis of said waveform information extracted by said waveform information extraction unit;

a compensation unit for compensating the synthesized waveform generated by the synthesized waveform generation unit with a signal corresponding to a region outside of the analysis region set by the analysis region setting unit;

a residual signal generation unit for generating a residual signal on the basis of said input signal divided by said input signal dividing unit and said compensating signal corresponding to the region outside the analysis region; and a coding unit for coding the information on the analysis region, the waveform information and the residual signal, wherein, said amplitude-value computation unit detects an attack position of said input signal, and said analysis region setting unit sets the attack position of said input signal, detected by said amplitude-value computation unit, as a start position of said analysis region, and said amplitude-value computation unit detects a release position of said input signal, and said analysis region setting unit sets a release position of said input signal, detected by said amplitude-value computation unit, as an end position of said analysis region.

2. An information extraction apparatus according to claim 1, wherein said compensation unit compensates the signal corresponding to a region outside said analysis region with a signal at a fixed level.

3. An information extraction apparatus according to claim 1, wherein said waveform information extraction unit extracts said waveform information by using generalized harmonic analysis from said input signal of said analysis region set by said analysis region setting unit.

4. An information extraction apparatus according to claim 1, wherein said synthesized waveform generation unit multiplies a part of said synthesized waveform with a predetermined function.

5. An information extraction method for extracting waveform information and synthesizing waveform generation of an input signal, the method comprising:

an input signal dividing step of dividing said input signal into predetermined regions;

an amplitude-value computation step of computing an amplitude value for each one of said predetermined regions of said input signal divided by a process of said input signal dividing step;

an amplitude-value analyzing step of computing an amplitude value for each one of said predetermined regions of said input signal divided by a process of said input signal dividing step, and determining whether or not the predetermined region contain an attack or a release on the basis of a change in the amplitude value;

an analysis region setting step of setting an analysis region within the predetermined regions once when the attack or release is determined to be within the predetermined region by said process of said amplitude-value analyzing step;

a waveform information extraction step of extracting waveform information of said input signal of said analysis region set by a process of said analysis region setting step;

a synthesized waveform generation step of generating a synthesized waveform on the basis of said waveform information extracted by a process of said waveform information extraction step;

a compensation step for compensating the synthesized waveform generated by the synthesized waveform generation unit with a signal corresponding to a region outside of the analysis region set by the analysis region setting unit;

a residual signal generation step of generating a residual signal on the basis of said input signal divided by a process of said input signal dividing step and said compensating signal generated by a process of said compensation step; and a coding step for coding the information on the analysis region, the waveform information and the residual signal, wherein, an attack position of said input signal is detected in said amplitude-value computation step detects and is set as a start position of said analysis region in said analysis region setting step, and a release position is detected in said amplitude-value computation step and is set as an end position of said analysis region in said analysis region setting step.

6. A recording medium having a computer-readable program recorded thereon, said computer-readable program being executable on a processor, said program comprising:

an input signal dividing step of dividing said input signal into predetermined regions;

an amplitude-value analyzing step of computing an amplitude value for each one of said predetermined regions of said input signal divided by a process of said input signal dividing step, and determining whether or not the predetermined region contain an attack or a release on the basis of a change in the amplitude value;

an analysis region setting step of setting an analysis region within the predetermined regions once when the attack or release is determined to be within the predetermined region by said process of said amplitude-value analyzing step;

a waveform information extraction step of extracting waveform information of said input signal of said analysis region set by a process of said analysis region setting step;

a synthesized waveform generation step of generating a synthesized waveform on the basis of said waveform information extracted by a process of said waveform information extraction step;

a compensation step for compensating the synthesized waveform generated by the synthesized waveform generation unit with a signal corresponding to a region outside of the analysis region set by the analysis region setting unit;

a residual signal generation step of generating a residual signal on the basis of said input signal divided by a process of said input signal dividing step and said compensating signal generated by a process of said compensation step; and a coding step for coding the information on the analysis region, the waveform information and the residual signals, wherein, an attack position of said input signal is detected in said amplitude-value computation step detects and is set as a start position of said analysis region in said analysis region setting step, and a release position is detected in said amplitude-value computation step and is set as an end position of said analysis region in said analysis region setting step.

7. An information extraction apparatus comprising:

an input signal dividing unit for dividing an input signal into predetermined regions;

an amplitude-value analyzing unit for computing an amplitude value for each one of said predetermined regions of said input signal divided by said input signal dividing unit, and determining whether or not the predetermined region contain an attack or a release on the basis of a change in the amplitude value;

an analysis region setting unit for setting an analysis region within the predetermined region once when the attack or release is determined to be within the predetermined region by said amplitude-value analyzing unit;

a waveform information extraction unit for extracting waveform information of a predetermined frequency of said input signal of said analysis region set by said analysis region setting unit;

a synthesized waveform generation unit for generating a synthesized waveform on the basis of said waveform information extracted by said waveform information extraction unit;

a compensation unit for compensating the synthesized waveform generated by the synthesized waveform generation unit with a signal corresponding to a region outside of the analysis region set by the analysis region setting unit;

a residual signal generation unit for generating a residual signal on the basis of said input signal divided by said input signal dividing unit and said compensating signal corresponding to the region outside the analysis region;

a comparison unit for comparing the energy of said residual signal generated by said residual signal generation unit with a predetermined threshold value;

a feedback unit for feeding back said residual signal, instead of said input signal, to said amplitude-value analyzing unit on the basis of a comparison result of said comparison unit, and a coding unit for coding the information on the analysis region, the waveform information and the residual signal, wherein, said amplitude-value analyzing unit detects a position of said attack of said input signal, and said analysis region setting unit sets the attack position of said input signal, detected by said amplitude-value analyzing unit, as a start position of said analysis region, and said amplitude-value analyzing unit detects a position of said release of said input signal, and said analysis region setting unit sets the release position of said input signal, detected by said amplitude-value analyzing unit, as an end position of said analysis region.

8. An information extraction apparatus according to claim 7, wherein said compensation unit compensates a signal corresponding to a region outside said analysis region with a signal at a fixed level.

9. An information extraction apparatus according to claim 7, wherein said waveform information extraction unit extracts said waveform information by using generalized harmonic analysis from said input signal of said analysis region set by said analysis region setting unit.

10. An information extraction apparatus according to claim 7, wherein said synthesized waveform generation unit multiplies a part of said synthesized waveform with a predetermined function.

11. An information extraction method for extracting waveform information and synthesizing waveform generation of an input signal, the method comprising:

an input signal dividing step of dividing said input signal into predetermined regions;

an amplitude-value analyzing step of computing an amplitude value for each one of said predetermined regions of said input signal divided by a process of said input signal dividing step, and determining whether or not the predetermined region contain an attack or a release on the basis of a change in the amplitude value;

an analysis region setting step of setting an analysis region within the predetermined regions once when the attack or release is determined to be within the predetermined region by said process of said amplitude-value analyzing step;

a waveform information extraction step of extracting waveform information of a predetermined frequency of said input signal of said analysis region set by a process of said analysis region setting step;

a synthesized waveform generation step of generating a synthesized waveform on the basis of said waveform information extracted by a process of said waveform information extraction step;

a compensation step for compensating the synthesized waveform generated by the synthesized waveform generation unit with a signal corresponding to a region outside of the analysis region set by the analysis region setting unit;

a residual signal generation step of generating a residual signal on the basis of said input signal divided by a process of said input signal dividing step and said synthesized waveform generated by a process of said synthesized waveform generation step;

a comparison step of comparing an energy of said residual signal generated by a process of said residual signal generation step with a predetermined threshold value; and a feedback step of feeding back said residual signal, instead of said input signal, to by a process of said amplitude-value analyzing step on the basis of a comparison result by a process of said comparison step, and a coding unit step for coding the information on the analysis region, the waveform information and the residual signal, wherein, an attack position of said input signal is detected in said amplitude-value computation step detects and is set as a start position of said analysis region in said analysis region setting step, and a release position is detected in said amplitude-value computation step and is set as an end position of said analysis region in said analysis region setting step.

12. A recording medium having a computer-readable program recorded thereon, said computer-readable program being executable on a processor, said program comprising:

an input signal dividing step of dividing said input signal into predetermined regions;

an amplitude-value analyzing step of computing an amplitude value for each one of said predetermined regions of said input signal divided by a process of said input signal dividing step, and determining whether or not the predetermined region contain an attack or a release on the basis of a change in the amplitude value;

an analysis region setting step of setting an analysis region within the predetermined regions once when the attack or release is determined to be within the predetermined region by said process of said amplitude-value analyzing step;

a waveform information extraction step of extracting waveform information of a predetermined frequency of said input signal of said analysis region set by a process of said analysis region setting step;

a synthesized waveform generation step of generating a synthesized waveform on the basis of said waveform information extracted by a process of said waveform information extraction step;

a compensation step for compensating the synthesized waveform generated by the synthesized waveform generation unit with a signal corresponding to a region outside of the analysis region set by the analysis region setting unit;

a residual signal generation step of generating a residual signal on the basis of said input signal divided by a process of said input signal dividing step and said synthesized waveform generated by a process of said synthesized waveform generation step;

a comparison step of comparing an energy of said residual signal generated by a process of said residual signal generation step with a predetermined threshold value; and a feedback step of feeding back said residual signal, instead of said input signal, to by a process of said amplitude-value analyzing step on the basis of a comparison result by a process of said comparison step, and a coding unit step for coding the information on the analysis region, the waveform information and the residual signal, an attack position of said input signal is detected in said amplitude-value computation step detects and is set as a start position of said analysis region in said analysis region setting step, and a release position is detected in said amplitude-value computation step and is set as an end position of said analysis region in said analysis region setting step.

13. An information extraction apparatus for receiving information on an extraction region, waveform information, and a residual signal from an signal coding apparatus, said information synthesis apparatus comprising:

a synthesis region setting unit for setting a synthesis region on the basis of information on said extracted region;

a synthesized signal generation unit for generating a synthesized signal on the basis of said waveform information; and a reproduced signal generation unit for generating a reproduced signal on the basis of said residual signal and said synthesized signal wherein, the signal coding apparatus is configured for dividing an input signal into predetermined regions, computing an amplitude value for each one of said predetermined regions of said divided input signal, determining whether or not the predetermined region contain an attack or a release on the basis of a change in the amplitude value, setting an analysis region within the predetermined region once when the attack or release is determined to be within the predetermined region, setting an extraction region within based on amplitude value of the analysis region, extracting waveform information of the extracted region, generating a synthesized waveform from the extracted waveform information, and generating a residual signal on the basis of a signal in the divided region and the synthesized waveform, and for synthesizing signals corresponding to the input signal, said synthesis region setting unit sets an attack position of said input signal as the start position of said synthesis region on the basis of information on said extracted region, and said synthesis region setting unit sets a release position of said input signal as the end position of said synthesis region on the basis of information on said extracted region.

14. An information extraction apparatus according to claim 13, wherein said compensation unit compensates the signal corresponding to a region outside said synthesis region with a signal at a fixed level.

15. An information extraction method for synthesizing a signal corresponding to an input signal on the basis of information on an extracting region, waveform information, and a residual signal received from an information extraction apparatus, said information synthesis method comprising:

a synthesis region setting step of setting a synthesis region on the basis of information on said extracted region;

a synthesized signal generation step of generating a synthesized signal from said waveform information; and a reproduced signal generation step of generating a reproduced signal on the basis of said residual signal and said synthesized signal, wherein, the signal coding apparatus is configured for dividing an input signal into predetermined regions, computing an amplitude value for each one of said predetermined regions of said divided input signal, determining whether or not the predetermined region contain an attack or a release on the basis of a change in the amplitude value, setting an analysis region within the predetermined region once when the attack or release is determined to be within the predetermined region, setting an extraction region within based on amplitude value of the analysis region, extracting waveform information of the extracted region, generating a synthesized waveform from the extracted waveform information, and generating a residual signal on the basis of a signal in the divided region and the synthesized waveform, and for synthesizing signals corresponding to the input signal, an attack position of said input signal is set as a start position of said synthesis region in said synthesis region setting step on the basis of information on said extracted region, and a release position of said input signal is set as an end position of said synthesis region in said synthesis region setting step on the basis of information on said extracted region.

16. A recording medium having recorded thereon a computer-readable program for synthesizing a signal corresponding to an input signal on the basis of information on an extraction region, waveform information, and a residual signal, received from an information extraction apparatus, said computer-readable program being executable on a processor, said program comprising:

a synthesis region setting step of setting a synthesis region on the basis of information on said extracted region;

a synthesized signal generation step of generating a synthesized signal from said waveform information; and a reproduced signal generation step of generating a reproduced signal on the basis of said residual signal and said synthesized signal, wherein, the information extraction is configured for dividing an input signal into predetermined regions, computing an amplitude value for each one of said predetermined regions of said divided input signal, determining whether or not the predetermined region contain an attack or a release on the basis of a change in the amplitude value, setting an analysis region within the predetermined region once when the attack or release is determined to be within the predetermined region, setting an extraction region within based on amplitude value of the analysis region, extracting waveform information of the extracted region, generating a synthesized waveform from the extracted waveform information, and generating a residual signal on the basis of a signal in the divided region and the synthesized waveform, and for synthesizing signals corresponding to the input signal, an attack position of said input signal is set as a start position of said synthesis region in said synthesis region setting step on the basis of information on said extracted region, and a release position of said input signal is set as an end position of said synthesis region in said synthesis region setting step on the basis of information on said extracted region.

* * * * *

UNITED STATES PATENT AND TRADEMARK OFFICE

CERTIFICATE OF CORRECTION

PATENT NO. : 7,366,661 B2
APPLICATION NO. : 10/203733
DATED : April 28, 2008
INVENTOR(S) : Minoru Tsuji, Shiro Suzuki and Keisuke Toyama It is certified that error appears in the above-identified patent and that said Letters Patent is hereby corrected as shown below:

Title Page, insert Item

--(30) Foreign Application Priority Data

Dec. 14, 2000 (JP) P2000-380641--

Signed and Sealed this

Nineteenth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,366,661 B2 
APPLICATION NO. : 10/203733
DATED : April 29, 2008
INVENTOR(S) : Minoru Tsuji, Shiro Suzuki and Keisuke Toyama It is certified that error appears in the above-identified patent and that said Letters Patent is hereby corrected as shown below:

Title Page, insert Item

--(30) Foreign Application Priority Data

Dec. 14, 2000 (JP) P2000-380641--

This certificate supersedes the Certificate of Correction issued August 19, 2008.

Signed and Sealed this

Sixteenth Day of September, 2008

JON W. DUDAS
*Director of the United States Patent and Trademark Office*